US010322065B1

(12) United States Patent
Miceli et al.

(10) Patent No.: US 10,322,065 B1
(45) **Date of Patent: *Jun. 18, 2019**

(54) CLOSURE SYSTEMS FOR HOUSING PHARMACEUTICALS

(71) Applicant: Tri State Distribution, Inc., Sparta, TN (US)

(72) Inventors: David A. Miceli, Reno, NV (US); Joseph A. Miceli, Spencer, TN (US)

(73) Assignee: Tri State Distribution, Inc., Sparta, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/962,541

(22) Filed: Apr. 25, 2018

Related U.S. Application Data

(63) Continuation of application No. 14/812,347, filed on Jul. 29, 2015, now Pat. No. 10,052,258.

(60) Provisional application No. 62/030,195, filed on Jul. 29, 2014.

(51) Int. Cl.

| | |
|---|---|
| ***A61J 1/00*** | (2006.01) |
| ***A61J 1/14*** | (2006.01) |
| ***B65D 50/06*** | (2006.01) |

(52) U.S. Cl.
CPC ..... *A61J 1/1437* (2013.01); *A61J 1/00* (2013.01); *A61J 1/1418* (2015.05); *B65D 50/068* (2013.01); *A61J 2205/30* (2013.01); *A61J 2205/50* (2013.01)

(58) Field of Classification Search
CPC ..... A61J 1/1437; A61J 1/1418; A61J 1/00; A61J 2205/30; A61J 2205/50; B65D 50/068
USPC ..... 220/274, 277, 278; 215/220, 302; 81/3.29
See application file for complete search history.

(56) References Cited

U.S. PATENT DOCUMENTS

| | | | | |
|---|---|---|---|---|
| 1,932,147 A | | 10/1933 | Sabatine | |
| 2,203,911 A | * | 6/1940 | Krafty | B65D 17/521 30/411 |
| 2,921,705 A | | 1/1960 | Dorsey | |
| 3,164,277 A | * | 1/1965 | Reading | B65D 50/068 215/215 |
| 3,396,864 A | * | 8/1968 | Jones | B65D 50/068 215/215 |
| 3,485,402 A | * | 12/1969 | Tunstall | B65D 50/068 215/215 |
| 4,281,771 A | | 8/1981 | Siegal | |
| 4,496,065 A | | 1/1985 | Nagy | |

(Continued)

FOREIGN PATENT DOCUMENTS

DE 4421220 C1 11/1995

*Primary Examiner* — James N Smalley
(74) *Attorney, Agent, or Firm* — Luedeka Neely Group, P.C.

(57) ABSTRACT

A closure system includes an inner cap including a plurality of driving structures disposed proximate a periphery of a top surface of the inner cap, a child proof element separated from the inner cap configured to be assembled with the inner cap to form a child proof cap, and a key having a plurality of projections. The child proof element when assembled with the inner cap in a child proof mode is configured to require the plurality of projections of the key to engage at least a portion of the plurality of driving structures of the inner cap to remove the assembled child proof cap when the child proof cap is installed on the container.

26 Claims, 13 Drawing Sheets

(56) References Cited

U.S. PATENT DOCUMENTS

| | | | | | |
|---|---|---|---|---|---|
| 4,775,061 | A | | 10/1988 | Coote | |
| 5,147,052 | A | | 9/1992 | Minette | |
| 5,158,194 | A | * | 10/1992 | Sirgo | B65D 50/041 215/215 |
| 5,586,670 | A | | 12/1996 | Greenwald | |
| 5,873,475 | A | | 2/1999 | Volpe | |
| 6,029,834 | A | | 2/2000 | Sanner | |
| 2004/0074905 | A1 | * | 4/2004 | Haggard | B65D 51/24 220/278 |

* cited by examiner

CLOSURE SYSTEMS FOR HOUSING PHARMACEUTICALS

CROSS-REFERENCE TO RELATED APPLICATIONS

This application claims priority as a continuation application to co-pending U.S. application Ser. No. 14/812,347, filed Sep. 29, 2015, entitled "Method & System For Customizing Dispensing of Pharmaceuticals," which claimed priority to U.S. Provisional Application Ser. No. 62/030,195 filed Jul. 29, 2014, entitled "Child Proof Closure," the entire contents of both being incorporated herein in their entireties.

FIELD

This disclosure relates to a pharmaceutical closure system. More particularly, this disclosure relates to a pharmaceutical closure system that provides different modes of operation of increasing difficulty in removing the closure system from a container.

BACKGROUND

Many pharmaceutical container closure systems, and particularly prescription container closure systems, often include a "child resistant" mode of operation, and sometimes both "non-child resistant" and "child resistant" modes. While these types of closure systems are generally very effective in preventing a child from opening the closure in the child resistant configuration, it is not impossible for children to open them (hence the name "child resistant"). In particular, a child playing with this type of closure system may sometimes be drawn to certain locking/unlocking features, such as a push-down tab, visible on the cap resulting in the child unintentionally removing the cap from its container. Also, particularly in the case of push-down-and-turn child resistant closures, the child may even figure out how to remove the closure by simply watching their parents, or even reading instructions displayed on exterior of the closure, and then being able to do so on their own. Accordingly, what is needed, at least as an option for consumers that have young children in their household, is a "child proof" closure system.

While many "lock-and-key" type closure systems are disclosed in the prior art in an attempt to provide an effective "child proof" closure system, no such systems have been commercialized, at least on any significant scale. This is likely due to weakness of the designs that have been introduced so far, including designs that would not be effective in actually preventing children from being able to open the containers and designs having flaws that would make the closure systems expensive to manufacture and/or impractical from a commercial standpoint.

For example, U.S. Pat. No. 6,032,811 provides a cap assembly having an outer cap member and an inner cap member each having a key slot. While the outer cap is designed to rotate independently of the inner cap, a key may be inserted into the key slots to turn the inner cap when the key slots are aligned. One of the many problems with this overly simplistic design is that the key actually comes secured to the cap, the slot on the outer surface of the outer cap is clearly visible, and the slot is configured such that ordinary household items could be inserted into the slot. Accordingly, just like children toys that teach toddlers motor skills by inserting different shapes into different slots, certain children playing with the closure could end up inserting the key or other household object into the slots. Once the key is inserted correctly, whether intentionally or not, it is very likely that the child would be able to open the container. The prior art includes many other closure systems that suffer these same deficiencies. In fact, many of the systems are actually designed such that normal household items may be used to open the closure system, such as U.S. Pat. No. 3,396,864 patent, further described below, which includes a slot designed to be used with a coin. What is needed therefore is a more discrete locking system that makes it more difficult for a child to recognize or understand how to open the closure system or otherwise prevents attracting child actions that result in the child unintentionally opening the container.

Similarly, U.S. Pat. No. 3,485,402 provides a cap assembly with two opposing key hole openings in the outer cap operable to be aligned with opposing key holes on the inner cap for engagement with a key having opposed prongs. The openings of the inner and outer cap were not designed to be discreet but to allow the key to traverse the center of the cap that includes a screw to secure the inner cap within the outer cap. This design suffers several critical flaws, most critical of which is that an additional gasket (i.e., additional expense and complexity) is needed to prevent air, moisture, leakage, etc. from coming into or escaping the container opening due to the key holes of the inner cap and the screw that is inserted through the outer and inner caps. Further, the gasket extends into the opening of the container such that, like the '864 Patent described below, the '402 Patent does not permit induction sealing. Also, due to the key having to traverse, the screw extending from the outer cap, pushing down on the key to insert the key prongs into the key holes with the handle would actually pivot the prongs out of the key holes.

Additionally, like the gasket and screw of the '402 Patent, many of the prior art "child proof" closure systems include numerous parts, which adds thickness and cost to manufacturing the cap. For example, U.S. Pat. No. 4,796,768 describes a lockable closure cap that requires a standard type key, springs, cams, etc. to lock the closure to the container. As would be expected, this type of closure, while requiring a specialty key, would be expensive to manufacture. Further, all the various parts required to provide use of a standard key design results in a large and unattractive size for the closure and prevents the closure from being applied to a container in an automated dispensing system.

U.S. Pat. No. 3,396,864 and European Patent No. 06311945 disclose other locking caps having ratchet ramps on both the outer cap and inner cap that allow the closure assembly to be screwed onto a container when the outer cap is rotated in a clockwise direction but is designed to prevent the closure from being removed without a key when the outer cap is rotated in the counter-clockwise direction. While it is desirable in certain instances to be able to provide a closure that can be screwed onto a container but requires key to remove the closure, the '864 Patent is silent as to how this would be accomplished other than including ramps on both the inner cap and outer cap. Additionally, like many of the other locking closures of the prior art, including the '811 Patent described above, the key slots/indentions of the cap portions are centrally located in the '864 Patent and '945 Patent. This requires a pocket to be formed that extends into the interior space of the inner caps. The pocket is formed due to the needed depth of the slot of the inner cap that is configured to receive the key and prevents the opening of the closure from being lined in an induction sealing process as known in the art. Further, the pocket results in additional resin being needed to form the cap, adds needless weight to the cap, and slows down the molding/cycle time required to make the closure.

In another aspect, many closure systems, particularly those designed to be child resistant, are difficult to open and close for the elderly as well as those with arthiritic hand conditions. Thus, while it would be beneficial to provide a multifunctional key that not only unlocks the closure system but also assists a user in both screwing the closure system on and off a container, the prior art has generally ignored this aspect when designing the interaction between the keys and the closure systems. For example, the '864 Patent, '945 Patent, and '402 Patent described above provide locking closure systems in which the key engages a recess centrally located within the inner cap. Thus, the key is unable to provide much additional torque than what would already be supplied by a user that just rotates the outer cap upon engagement with the inner cap.

Further, likely because the locking closure systems of the prior art did not recognize or otherwise were unable to successfully implement a closure system in which the key provided an appreciable mechanical advantage in screwing the closure system on and off a container, none of these systems describe a closure having both a child resistant option and a key option. Such a system is advantageous in numerous situations. For example, both options may be preferred for elderly patients that have trouble opening and closing child resistant closures but also have caregivers that often dispense their medications. Thus, the elderly individual may desire a tool that assists in screwing the closure on and off a container, while the caregiver may wish to open the container using the normal child resistant function. Also, both options would be beneficial when a child resistant cap is secured to a container in automated dispensing systems. In this regard, workers required to perform spot checks of prescriptions that are dispensed in these automated systems must screw on and off countless child resistant caps, and, thus, often complain of hand pain and carpal tunnel symptoms. Providing these workers with a tool to quickly assist them in screwing on and off these child resistant caps would thus be beneficial. Also, liquid pharmaceuticals often result in the sticky pharmaceutical being spilled onto the driving structures of child resistant caps, making such structures generally ineffective. By providing a closure system in which both a child resistant and key option are available, the key can be utilized if the user has trouble opening the closure due to the driving structures having been exposed to spills of the liquid pharmaceutical.

In view of the above, what is needed therefore is a lockable closure assembly that, while providing a discrete locking system, is efficient to manufacture. Further, a system in which a user has more options of varying degrees of difficulty to open the closure system based on the consumer's particular circumstances, including a key that serves as an effective tool to make the closure system easy to open and close when used, is desired.

SUMMARY

A system and method of customizing the dispensing of a prescription pharmaceutical for a customer in a pharmaceutical container includes providing a quantity of a pharmaceutical closure system. The pharmaceutical closure system includes a non-child resistant cap configured to screw on and off the container in a non-child resistant mode to allow ready removal of the closure system when only the non-child resistant cap is installed on the container; a child resistant element that is separate from the non-child resistant cap and is configured so as to be able to be assembled with the non-child resistant cap to convert the non-child resistant cap to a child resistant cap, wherein the child resistant element when assembled with the non-child resistant cap in a child resistant mode is configured to permit removal of the assembled child resistant cap upon a push-down-and-turn action being applied to the child resistant element when the assembled child resistant cap is installed on the container; and a child proof element that is separate from the child resistant element and the non-child resistant cap and is configured so as to be able to be assembled with the non-child resistant cap to convert the non-child resistant cap to a child proof cap, wherein the child proof element when assembled with the non-child resistant cap in a child proof mode is configured to require a key to remove the assembled child proof cap when the assembled child proof cap is installed on the container. The method further includes determining whether the customer wants the non-child resistant cap, the child resistant cap, or the child proof cap on the container for the prescription of the customer; dispensing the prescription pharmaceutical in the container having only the non-child resistant cap when the customer does not want the child resistant cap or the child proof cap; converting the non-child resistant cap to the child resistant cap by assembling the child resistant element with the non-child resistant cap and dispensing the prescription pharmaceutical in the container having the assembled child resistant cap when the customer wants the child resistant cap; and converting the non-child resistant cap to the child proof cap by assembling the child proof element with the non-child resistant cap and dispensing the prescription pharmaceutical in the container having the assembled child proof cap when the customer wants the child proof cap. A key may also be provided to the customer configured to remove the assembled child proof cap when the customer wants the child proof cap.

According to certain embodiments, the determining and converting steps are performed at the pharmacy. In some embodiments, the method further includes installing the non-child resistant cap on the container before converting the non-child resistant cap to one of the child resistant cap and the child proof cap. In preferred embodiments, the child resistant element is configured so as to be able to be permanently assembled with the non-child resistant cap to permanently convert the non-child resistant cap to a child resistant cap and the child proof element is configured so as to be able to be permanently assembled with the non-child resistant cap to permanently convert the non-child resistant cap to a child proof cap.

According to certain embodiments, the child resistant element when assembled with the non-child resistant cap is configured so that the non-child resistant cap is positionable within the child resistant element to convert the assembled child resistant cap between the child resistant mode and a non-child resistant mode, wherein when the non-child resistant cap is positioned within the child resistant element in the non-child resistant mode the assembled child resistant cap is operable to be screwed on and off the container without a depressive force. Similarly, in certain embodiments, the child proof element when assembled with the non-child resistant cap is configured so that the non-child resistant cap is positionable within the child proof element to convert the assembled child proof cap between the child proof mode and a non-child resistant mode, wherein when the non-child resistant cap is positioned within the child proof element in the non-child resistant mode the assembled child proof cap is operable to be screwed on and off the container without requiring the key.

According to certain embodiments, the child resistant element when assembled with the non-child resistant cap in a child resistant mode is also configured to permit a key to be inserted through a portion of the child resistant element to engage the non-child resistant cap and remove the assembled child resistant cap installed on the container in a child resistant mode by rotation of the key.

According to another embodiment of the disclosure, closure system includes a non-child resistant cap including a plurality of driving structures disposed proximate a periphery of a top surface of the non-child resistant cap; a child resistant element separated from the non-child resistant cap and being configured to be assembled with the non-child resistant cap to convert the non-child resistant cap to a child resistant cap, the child resistant element including a plurality of driving structures disposed proximate the periphery of a top interior surface; a child proof element separated from the non-child resistant cap and being configured to be assembled with the non-child resistant cap to convert the non-child resistant cap to a child proof cap, the child proof element including at least one aperture disposed in a top surface of the child proof element; and a key having at least one projection. The child resistant element when assembled with the non-child resistant cap in a child resistant mode is configured so that the plurality of driving structures of the child resistant element engage the plurality of driving structures of the non-child resistant cap when rotating the child resistant element in a first direction to install the child resistant cap on the container and permit removal of the assembled child resistant cap upon the plurality of driving structures of the child resistant element engaging the plurality of driving structures of the non-child resistant cap when a push-down-and-turn action is applied to the child resistant element in a second direction. The child proof element when assembled with the non-child resistant cap in a child proof mode is configured to require the at least one projection of the key to be inserted through the at least one aperture of the child proof element to engage at least one of the plurality of driving structures of the non-child resistant cap to remove the assembled child proof cap when the child proof cap is installed on the container. In preferred embodiments, the child proof element includes a substantially smooth top interior surface without driving structures disposed thereon to form the child proof cap when assembled with the non-child resistant cap.

According to certain embodiments, the child resistant element further includes at least one aperture disposed in a top surface of the child resistant element, wherein the child resistant element when assembled with the non-child resistant cap in the child resistant mode is also configured to permit the at least one projection of the key to be inserted through the at least one aperture of the child proof element to engage at least one of the plurality of driving structures of the non-child resistant cap to remove the assembled child resistant cap installed on the container in the child resistant mode by rotation of the key.

According to certain embodiments, the child resistant element when assembled with the non-child resistant cap is configured so that the non-child resistant cap is positionable within the child resistant element to convert the assembled child resistant cap between the child resistant mode and a non-child resistant mode, wherein, when the non-child resistant cap is positioned within the child resistant element in the non-child resistant mode, the assembled child resistant cap is operable to be screwed on and off the container without a depressive force. Similarly, the child proof element when assembled with the non-child resistant cap may be configured so that the non-child resistant cap is positionable within the child proof element to convert the assembled child proof cap between the child proof mode and a non-child resistant mode, wherein, when the non-child resistant cap is positioned within the child proof element in the non-child resistant mode, the assembled child proof cap is operable to be screwed on and off the container without requiring the key.

According to certain embodiments, each of the plurality of driving structures of the non-child resistant cap include a recess disposed in the top surface of the non-child resistant cap, the recess including a bottom wall in axial alignment with the top surface and a pair of opposing side walls extending substantially perpendicular from the bottom wall to the top surface. According to this embodiment, each of the plurality of driving structures of the child resistant element preferably include ratchet ramps, the ratchet ramps operable to engage one of the side walls of each of the recesses of the non-child resistant cap when the child resistant element is rotated in the first direction without a depressive force while requiring the depressive force for the ratchet ramps to engage the opposing side walls of the recesses when the child resistant element is rotated in the second direction.

According to another embodiment of the disclosure, a method and system of customizing the dispensing of a prescription pharmaceutical for a customer in a pharmaceutical container includes providing a quantity of a pharmaceutical closure system. The closure system includes a non-child resistant cap configured to screw on and off the container in a non-child resistant mode to allow ready removal of the closure system when only the non-child resistant cap is installed on the container, and a child resistant element that is separate from the non-child resistant cap and is configured so as to be able to be permanently assembled with the non-child resistant cap to convert the non-child resistant cap to a child resistant cap. The child resistant element, when assembled with the non-child resistant cap, is configured so that the non-child resistant cap is positionable within the child resistant element to convert the assembled child resistant cap between a child resistant mode and a non-child resistant mode, the child resistant mode being configured to permit removal of the assembled child resistant cap upon a push-down-and-turn action being applied to the child resistant element when the assembled child resistant cap is installed on the container and the non-child resistant mode being configured so that the assembled child resistant cap is operable to be screwed on and off the container in a non-child resistant mode. The method further includes determining whether the customer wants the non-child resistant cap or the child resistant cap for the prescription of the customer; dispensing the prescription pharmaceutical in the container having only the non-child resistant cap when the customer does not want the child resistant cap; and converting the non-child resistant cap to the child resistant cap by assembling the child resistant element with the non-child resistant cap and dispensing the prescription pharmaceutical in the container having the assembled child resistant cap when the customer wants the child resistant cap.

According to certain embodiments, the method further includes determining whether the customer wants the child resistant cap in the child resistant mode or the non-child resistant mode when the customer wants the child resistant cap; positioning the non-child resistant cap within the child resistant element for the child resistant mode when the customer wants the child resistant cap to be in the child resistant mode; and positioning the non-child resistant cap within the child resistant element for the non-child resistant mode when the customer wants the child resistant cap to be in the non-child resistant mode.

In yet another embodiment, a method and system of customizing the dispensing of a prescription pharmaceutical for a customer in a pharmaceutical container includes providing a quantity of a pharmaceutical closure system. The closure system includes a non-child resistant cap configured to screw on and off the container in a non-child resistant mode to allow ready removal of the closure system when only the non-child resistant cap is installed on the container, and a child proof element that is separate from the non-child resistant cap and is configured so as to be able to be permanently assembled with the non-child resistant cap to convert the non-child resistant cap to a child proof cap. The child proof element, when assembled with the non-child resistant cap, is configured so that the non-child resistant cap is positionable within the child proof element to convert the assembled child proof cap between a child proof mode and a non-child resistant mode, the child proof mode being configured to require a key to remove the assembled child proof cap when the assembled child proof cap is installed on the container and the non-child resistant mode being configured so that the assembled child resistant cap is operable to be screwed on and off the container in a non-child resistant mode. The method further includes determining whether the customer wants the non-child resistant cap or the child proof cap for the prescription of the customer; dispensing the prescription pharmaceutical in the container having only the non-child resistant cap when the customer does not want the child proof cap; and converting the non-child resistant cap to the child proof cap by assembling the child proof element with the non-child resistant cap and dispensing the prescription pharmaceutical in the container having the assembled child proof cap when the customer wants the child proof cap.

According to certain embodiments, the method further includes determining whether the customer wants the child proof cap in the child proof mode or the non-child resistant mode when the customer wants the child proof cap; positioning the non-child resistant cap within the child proof element for the child proof mode when the customer wants the child proof cap to be in the child resistant mode; and positioning the non-child resistant cap within the child proof element for the non-child resistant mode when the customer wants the child proof cap to be in the non-child resistant mode.

According to another aspect of the disclosure, a key for opening a closure system is disclosed having a base surface; a set of projections extending from the base surface in a first direction, the set of projections dimensioned and configured to be inserted through the at least one set of apertures of an outer cap to engage at least one set of driving structures of an inner cap when the at least one set of apertures and at least one set of driving structures of the assembled closure system are vertically aligned. The key is further dimensioned and configured to correspond to the outer cap such that the base surface of the key abuts the top surface of the outer cap when the at least one set of projections of the key are engaged with the at least one set of driving structures of the inner cap. In preferred embodiments, the set of projections are positioned to engage the at least one set of driving structures of the inner cap through at least one set of apertures disposed proximate an outer periphery of the top surface of the outer cap.

According to certain embodiments, the set of projections of the key are disposed proximate the periphery of the base surface. The key may also include a side wall extending from the base surface in the first direction coaxially with the set of projections. According to this embodiment, the key is preferably dimensioned and configured so that the set of projections will align with the at least one set of apertures of the outer cap upon substantially aligning an interior surface of the side wall of the key with an exterior surface of the side wall of the outer cap and rotating the key with respect to the outer cap. The side wall of the key is then operable to slide down the side wall of the outer cap upon the set of projections of the key becoming aligned with the at least one set of apertures of the outer cap and engaging the at least one set of driving structures of the inner cap.

According to preferred embodiments, the base surface of the key is cylindrical and the side wall is a circumferential side wall extending from an outer periphery of the cylindrical base surface to correspond to the top surface and side wall of the outer cap. According to certain embodiments, the key further includes a second set of projections extending from the base surface in a second direction opposite the first direction, the second set of projections positioned on the base surface to correspond to a second outer cap of different dimensions than the first outer cap.

According to yet another embodiment of the disclosure, a key includes a base surface and a side wall extending from at least a portion of the base surface in a first direction. At least one projection extends from the base surface in the first direction coaxially with the side wall, the at least one projection dimensioned and configured to be inserted through the at least one aperture of the outer cap to engage the at least one driving structure of the inner cap when the at least one aperture and at least one driving structure of the assembled closure system are vertically aligned. The key is further dimensioned and configured to correspond to the outer cap such that at least a portion of the base surface of the key abuts the top surface of the outer cap and at least a portion of the side wall of the key abuts the side wall of the outer cap when the at least one projection of the key is engaged with the at least one driving structure of the inner cap.

According to certain embodiments, the key is dimensioned and configured so that the at least one projection will align with the at least one aperture of the outer cap upon aligning the side wall of the key with the side wall of the outer cap and rotating the key with respect to the outer cap. Upon the at least one projection of the key becoming aligned with the at least one aperture of the outer cap and engaging the at least one driving structure of the inner cap, the side wall of the key is operable to slide down the side wall of the outer cap.

According to some embodiments, the key further includes at least a second projection and a second side wall extending from the top surface in a second direction opposite the first direction, the second projection and second side wall dimensioned and configured to correspond to a second outer cap of different dimensions than the first outer cap.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

The present disclosure provides a closure system that provides a user the option to easily convert a non-child resistant closure system to either a "child resistant" or "child proof" closure system depending on the difficulty desired in removing the closure system from a container. While the closure system is primarily directed for use with containers intended to store and dispense pharmaceutical products, and particularly prescription pharmaceuticals, it should be understood that the system may also be used for other applications such as household cleaners, pesticides, and any other product containing dangerous chemicals. Further, it should be understood that the term "child proof" as used herein does not necessarily require it to be impossible for a child to open the closure system but is used to denote a configuration that is more difficult to open than a "child resistant" configuration by virtue of the system requiring a foreign object, and preferably a specially designed key, to remove the closure system from the container.

Figure 1:
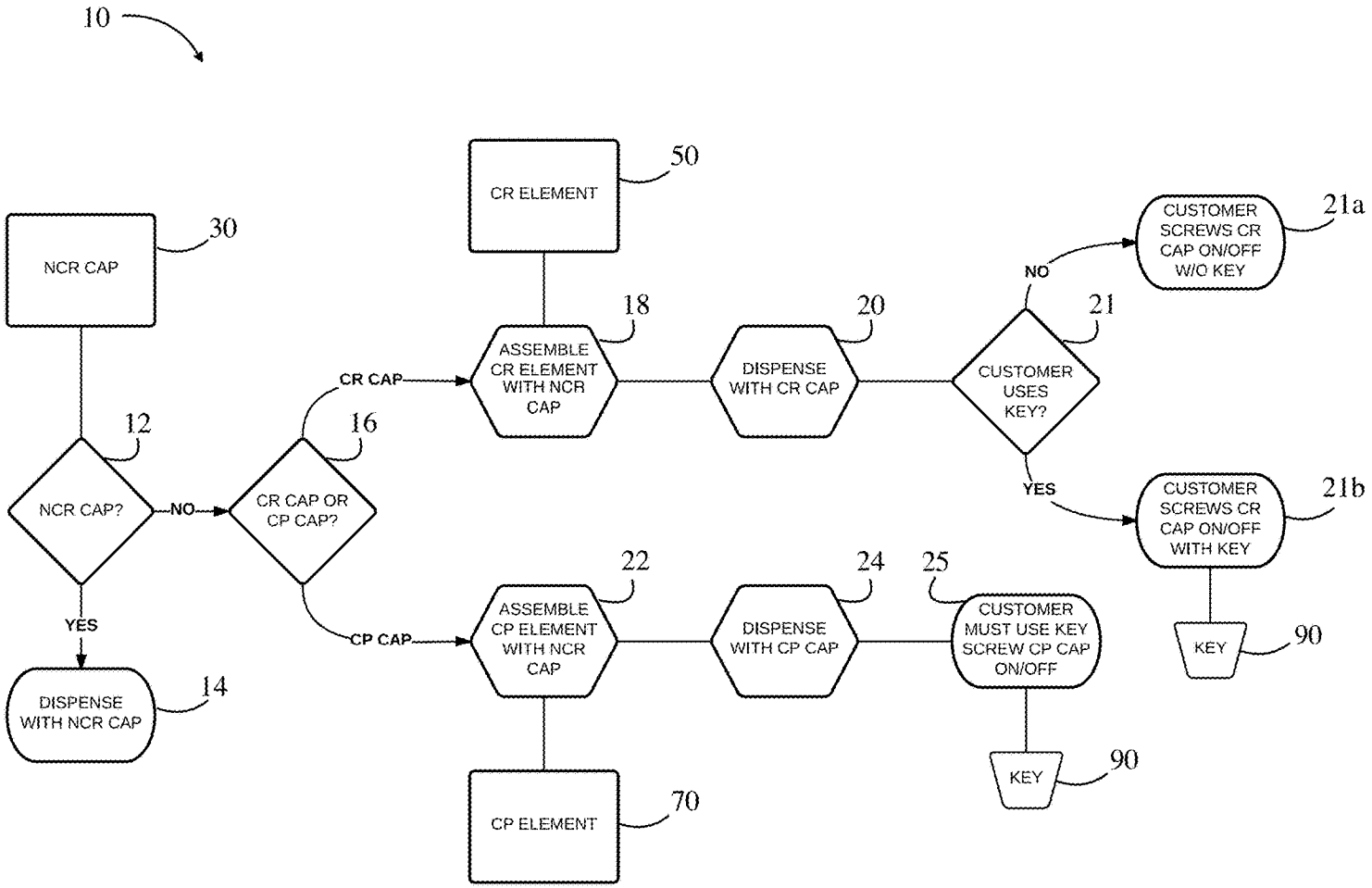
FIG. 1 is a flow chart depicting an exemplary methodology for dispensing and using a closure system according to one embodiment of the disclosure.
Figure 2:
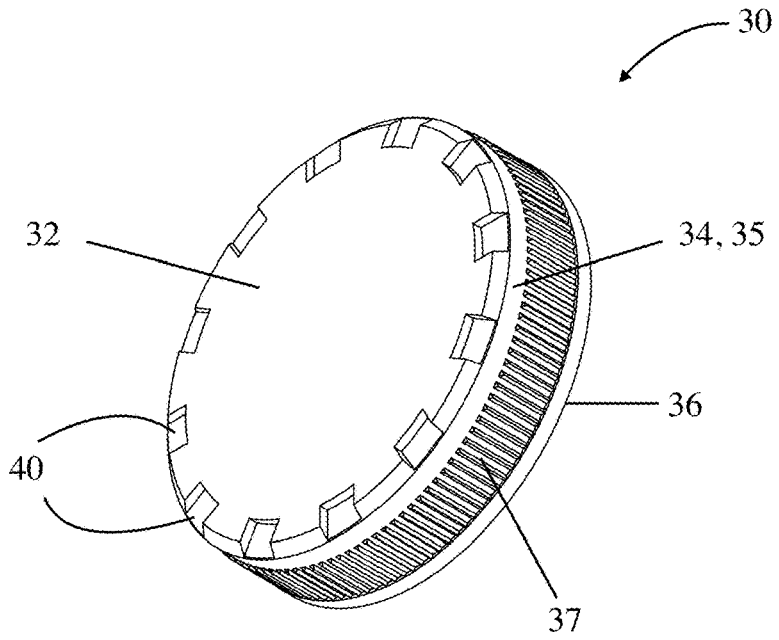
FIG. 2 is a top perspective view of a NCR cap according to one embodiment of the disclosure.
Figure 3:
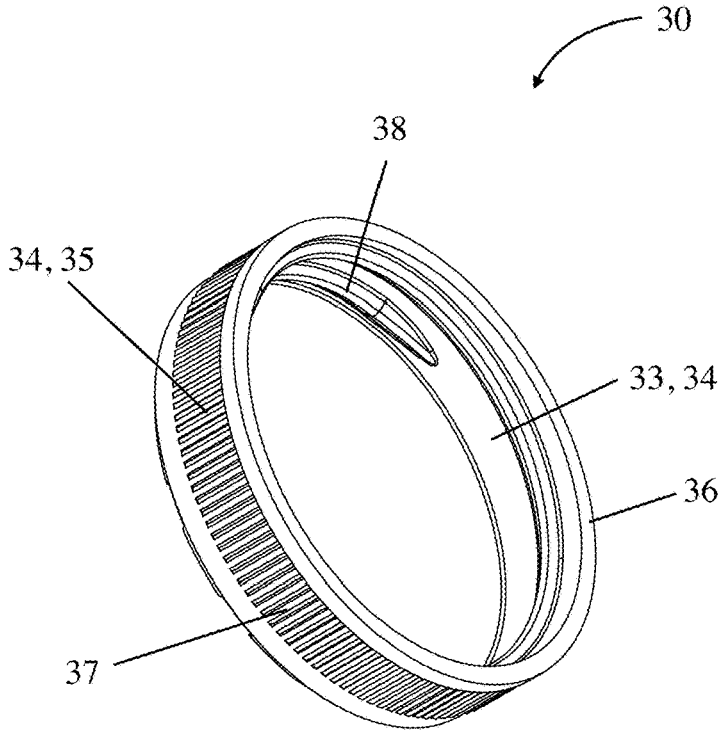
FIG. 3 is a bottom perspective view of the NCR cap of FIG. 2.
Figure 4:
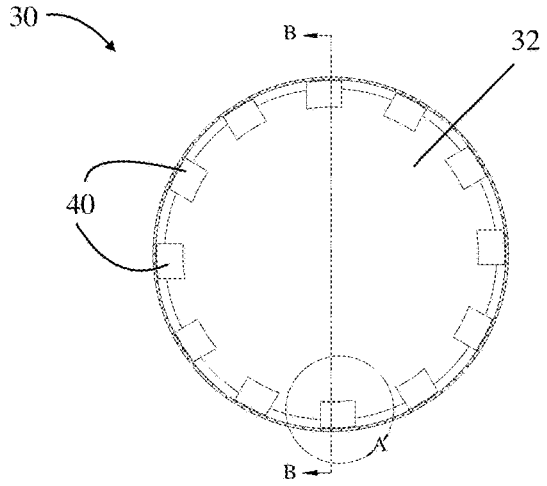
FIG. 4 is a top view of the NCR cap of FIGS. 2-3.
Figure 4A:
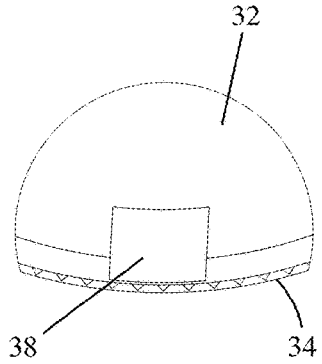
FIG. 4A is an exploded view of the "A" region of FIG. 4.
Figure 4C:
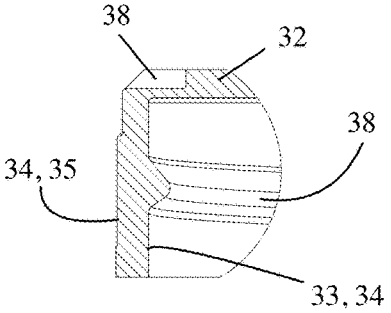
FIG. 4C is an exploded view of the "C" region of FIG. 4B.
Figure 4B:
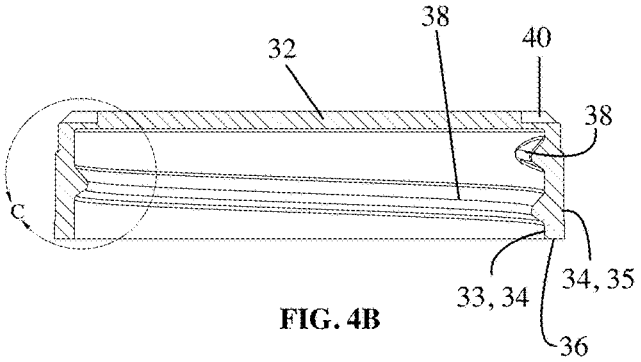
FIG. 4B is a cross sectional view taken from plane "B" of FIG. 4.

Referring to the flowchart of FIG. 1, the closure system 10 of the present disclosure includes a non-child resistant cap ("NCR cap") 30, a child resistant element ("CR element") 50, a child proof element ("CP element") 70, and a key 90. As will be understood from the description below, each of the NCR cap 30, CR element 50, CP element 70, and key 90 are initially provided as separate and distinct structures. In a first non-child resistant configuration, the NCR cap 30 is configured to screw on and off an appropriate container in a non-child resistant mode to allow ready removal of the closure system 10 when only the NCR cap 30 is installed on the container. However, when a child resistant cap is desired, the CR element 50 is configured to be assembled with the NCR cap 30 to convert the NCR cap 30 to a child resistant cap. Alternatively, when an even more difficult to open closure system is desired, the CP element 70 is configured to be assembled with the NCR cap 30 to convert the NCR cap 30 to a child proof cap. In preferred embodiments, the CR element 50 and CP element 70 are configured to be permanently fixed to the NCR cap 30. Thus, a user substantially unrelated to the manufacturer of the closure system 10 has the ability to 1) dispense the pharmaceutical in a NCR cap 30; 2) permanently convert the NCR cap 30 to a child resistant cap by assembling the NCR cap 30 with a CR element 50; or 3) permanently convert the NCR cap 30 to a child proof cap by assembling the NCR cap 30 with a CP element 70.

Accordingly, in step 12, a user first determines whether a NCR cap 30 is desired or is all that is needed for the particular circumstances. For example, in step 12, a pharmacist first determines whether the customer wants a NCR cap 30 (e.g., an elderly customer with no young children in their household) or whether the customer wants or needs a cap that is more difficult to remove from the container (e.g., a customer with small children at home). If only a NCR cap 30 is needed or desired, the user dispenses the pharmaceutical with just the NCR cap 30 installed to the container in step 14. On the other hand, if the user determines in step 12 that a more difficult to open closure system is needed, the user next determines in step 16 whether a child resistant cap or a child proof cap is desired. When the user determines in step 16 that a child resistant cap is desired, the user assembles the CR element 50 with the NCR cap 30 to form a child resistant cap in step 18 and dispenses the pharmaceutical with the child resistant cap installed on the container in step 20. However, when the user determines in step 16 that a child proof cap is desired, the user assembles the CP element 70 with the NCR cap 30 to form a child proof cap in step 22 and dispenses the pharmaceutical with the child proof cap installed on the container in step 24.

As noted in step 25, the child proof cap includes a child proof mode requiring a key 90 to remove the assembled child proof cap from the container. On the other hand, the child resistant cap includes a child resistant mode intended to make it difficult to remove the child resistant cap from the container, but stops short of requiring the separate key 90. In certain embodiments, the child resistant cap may be removed only by applying a depressive force on the CR element 50 while rotating the cap (i.e., the child resistant cap is removed using a "push-down-and-turn" action as known in the art). However, in preferred embodiments, the child resistant cap is configured so that the key 90 may also be used to remove the assembled child resistant cap when desired due to the mechanical advantages of using the key as described below. Thus, as shown in step 21, a customer that has been dispensed a child resistant cap is provided with an additional option of whether to screw the child resistant cap on and/or off the container without the key as shown in step 21*a* (e.g., by applying a push-down-and-turn action) or with the key in step 21*b*.

Additionally, referring to the flow chart of FIG. 19 and as further described below, the assembled child resistant cap and/or assembled child proof cap, according to certain embodiments, are further operable to be converted from the child resistant/child proof mode to a non-child resistant mode. In other words, the CR element 50 and NCR cap 30 may be configured to be assembled together to form a child resistant cap that is further convertible between a child resistant mode and a non-child resistant mode, while the CP element 70 and NCR cap 30 may be assembled together to form a child proof cap that is further convertible between a child proof mode and a non-child resistant mode.

In certain embodiments, the "user" is a traditional pharmacy that makes the determination of the type of cap to be installed on the container at the time of dispensing a prescription based on the preferences of the customer to which the prescription is being dispensed. In other embodiments, the user is a mail order pharmacy that makes the determination based on input from the customer order or stored preferences of the customer in the pharmacy database. In alternate embodiments, the prescription is dispensed to the customer with the NCR cap 30 installed on the container and the CR element 50 and CP element 70 provided separately to the customer. Accordingly, in this embodiment, the customer is a "user" that later makes the determination of the type of cap needed or desired after the pharmaceutical is dispensed with the NCR cap 30 thereon. For purposes of clarification, "user" generally refers herein to the individual or entity making the determination of how to assemble the closure system while the term "customer" refers to the individual or entity to which the user dispenses a container with the closure system 10 installed thereon in the chosen configuration. In certain circumstances, it should be understood that the "user" and "customer" may refer to the same individual or entity, such as when the "customer" makes the determination of whether to install the CR element 50 or CP element 70 to the NCR cap 30 after being dispensed a container with only the NCR cap 30 installed thereon.

Figure 5:
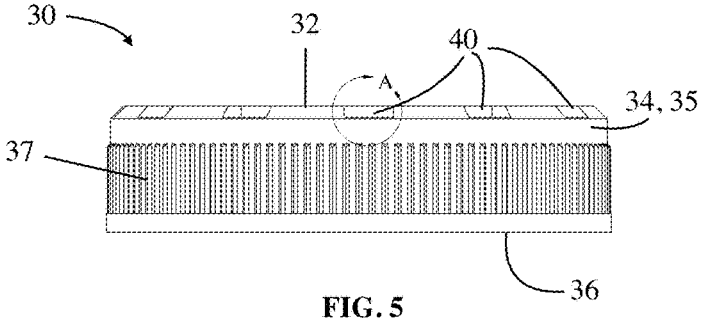
FIG. 5 is a side view of the NCR CAP of FIGS. 2-4.
Figure 5A:
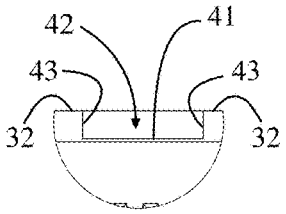
FIG. 5A is an exploded view of the "A" region of FIG. 5.
Figure 6:
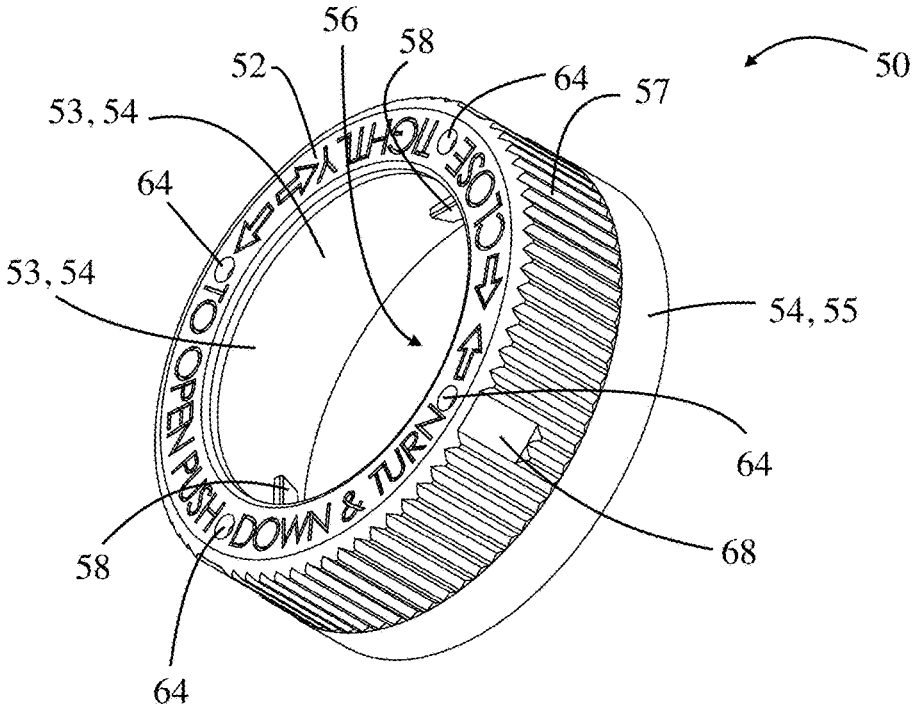
FIG. 6 is a top perspective view of a CR element according to one embodiment of the disclosure.
Figure 7:
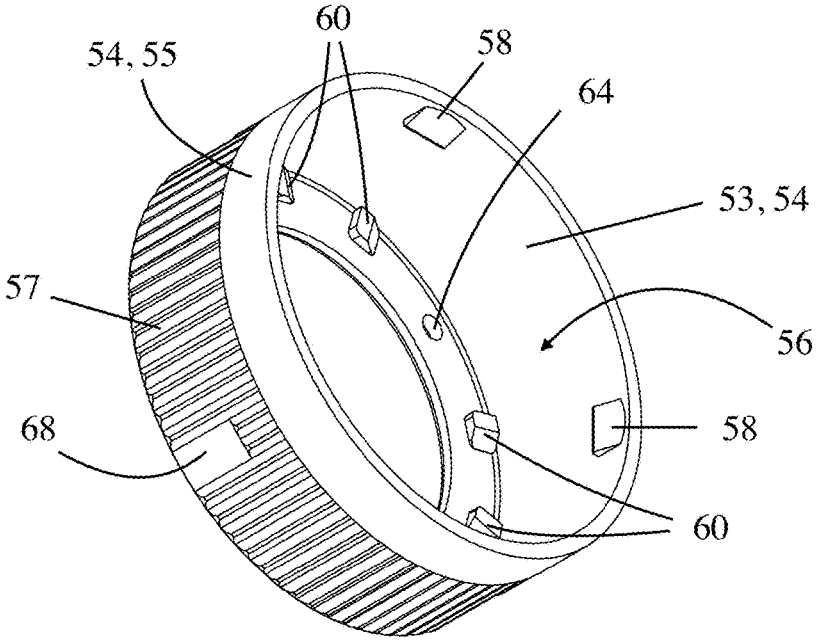
FIG. 7 is a bottom perspective view of the CR element of FIG. 6.
Figure 8:
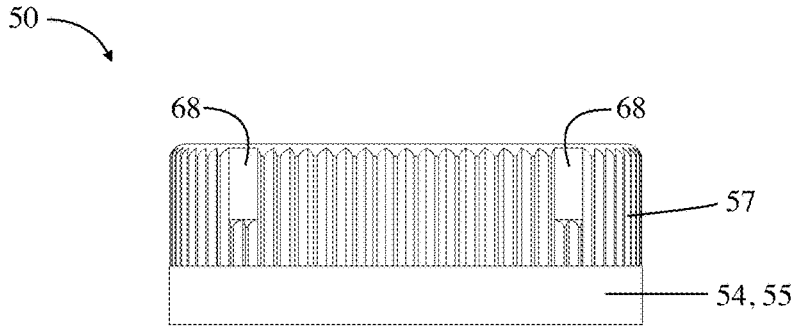
FIG. 8 is a side view of the CR element of FIGS. 6-7.

One embodiment of closure system 10 is exemplified in FIGS. 2-16. According to this embodiment, as shown in FIGS. 2-5, the NCR cap 30 includes a closed top surface 32, a circumferential side wall 34 extending downward from an outer periphery of the top surface 32 to create an open bottom surface 36, a closure engaging mechanism 38 disposed on an interior surface 33 of the circumferential side wall 34, and a plurality of driving structures 40 preferably disposed proximate the outer periphery of the closed top surface 32. In preferred embodiments (for reasons explained further below) and as best shown in the exploded view of FIG. 5A, each of the plurality of driving structures 40 are best described as "pockets" that include a recess 42 formed into the top surface 32, where the recess 42 includes a bottom wall 41 that is coaxial with the top surface 32 and a pair of opposing side walls 43 extending substantially perpendicular from the bottom wall 41 to the top surface 32.

The closure engaging mechanism 38 of NCR cap 30 is dimensioned and configured to engage in conventional manners a corresponding engaging mechanism of a container such that the closed top surface 32 covers the opening of the container. Thus, as noted above, the NCR cap 30 is configured to be installed and removed from the container in a non-child resistant mode to allow ready removal of the closure system 10 when only a non-child resistant mode is desired by the user. In preferred embodiments, the closure engaging mechanism 38 is a single thread disposed on the interior surface 33 of the circumferential side wall 34 as shown. However, the closure engaging mechanism 38 could also be a double thread, one or more beads, or other similar engaging mechanisms known in the art. The NCR cap 30 may also include a gripping element 37 disposed on an exterior surface 35 of the circumferential side wall, such as knurlments, to provide a gripping surface for screwing on and off the NCR cap 30 in the non-child resistant mode (i.e., when the NCR cap 30 is used unassembled from the CR element 40 and CP element 60).

Referring to FIGS. 6-10, the CR element 50 also includes a top surface 52 and a circumferential side wall 54 extending downward from an outer periphery of the top surface 52 to create an open bottom 56. The CR element 50 is shown as having an open top surface 52 such that a portion of the closed top surface 32 of the NCR cap 30 is visible when the CR element 50 is assembled with the NCR cap 30, but the CR element 50 may alternately include a solid top surface not allowing the NCR cap 30 to be visible in the child resistant configuration. Similar to the NCR cap 30, the circumferential side wall 54 may include a gripping element 57 to facilitate rotation of the CR element 50.

Figure 9:
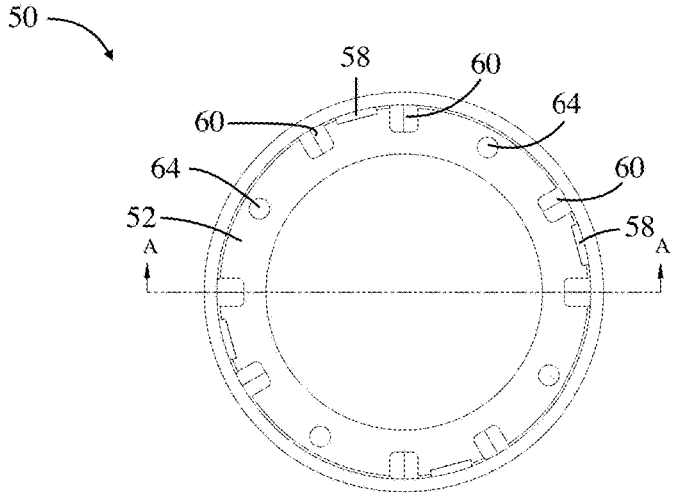
FIG. 9 is a bottom view of the CR element of FIGS. 6-8.
Figure 9A:
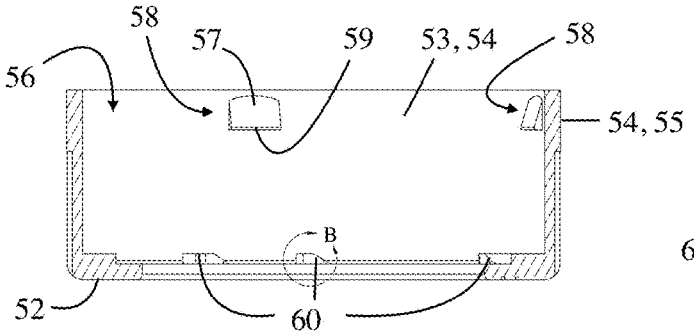
FIG. 9A is a cross sectional view taken from plane "A" of FIG. 9.

The interior surface 53 of the circumferential side wall 54 includes a tab element 58 for engaging the bottom surface 36 of the NCR cap 30 to secure the NCR cap 30 within the CR element 50. While the tab element 58 could be a solid or segmented bead, the tab element 58 is preferably a plurality of ramps as shown. As best shown in the cross-sectional view of FIG. 9A, each ramp 58 includes an angled ramp surface 57 leading to a substantially flat surface 59 that is substantially perpendicular to side wall 54. The angled ramp surface 57 facilitates the side wall 34 of the NCR cap 30 in traversing the side wall 54 of the CR element 50 until the flat surface 59 engages the bottom surface 36 of the NCR cap 30. Once the flat surface 59 of the CR element 50 engages the bottom surface 36 of the NCR cap 30, the NCR cap 30 is generally considered permanently assembled within the CR element 50 to prevent any unwanted shelling or removal of the CR element from the NCR cap 30. It is noted that, with this configuration where the NCR cap 30 slides through the open bottom 56 of the CR element 50, the CR element 50 is operable to be installed either before or after the NCR cap 30 is installed on a container.

The CR element 50 is further provided with a plurality of driving structures 60 disposed along the interior of the top surface 52 operable to engage the plurality of driving structures 40 of the NCR cap in the child resistant configuration. In this regard, the driving structures 40 and 60 are preferably dimensioned and configured such that the driving structures 60 of the CR element 50 freely engage the driving structures 40 of the NCR cap 30 when the CR element 50 is rotated in a first direction, preferably in a clockwise direction, thereby permitting the closure engaging mechanism 38 of the NCR cap 30 to be rotated along a corresponding container engaging mechanism for securing the assembled closure to a container in the child resistant configuration. However, when the CR element 50 is rotated in a second direction to remove the assembled closure from the container, a depressive force is required in order for the driving structures 60 of the CR element 50 to engage the driving structures 40 of the NCR cap 30. Thus, assembling the CR element 50 with the NCR cap 30 preferably converts the NCR cap 30 to a "push-down-and-turn" child resistant cap.

Figure 9B:
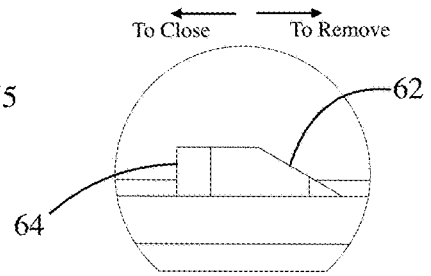
FIG. 9B is an exploded view of region "B" of FIG. 9A.
Figure 10:
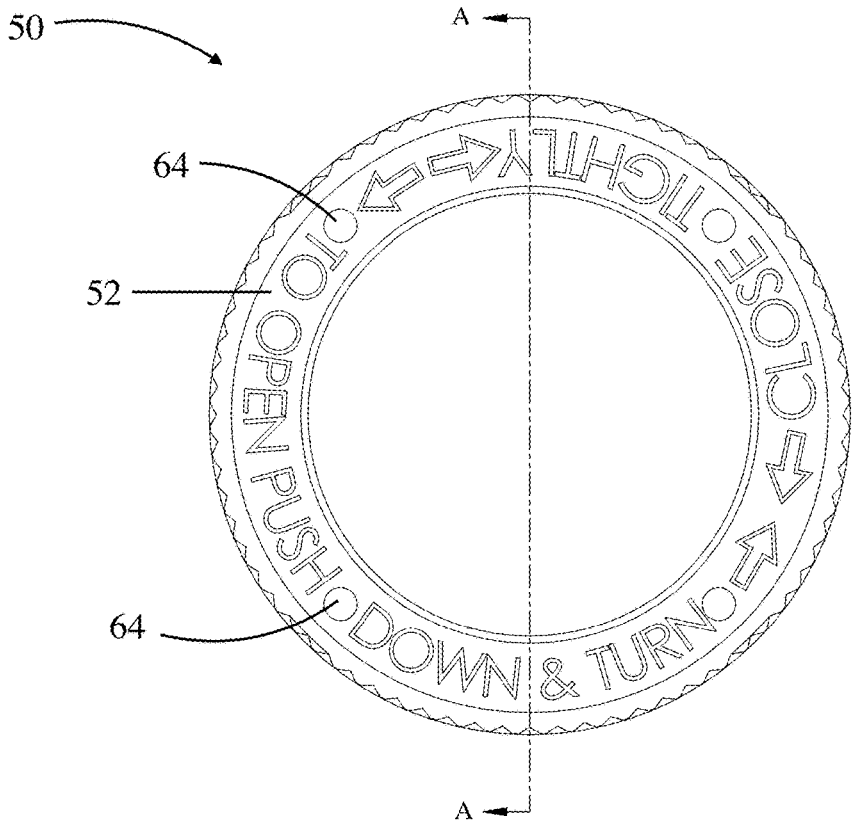
FIG. 10 is a top view of the CR element of FIGS. 6-9.
Figure 10A:
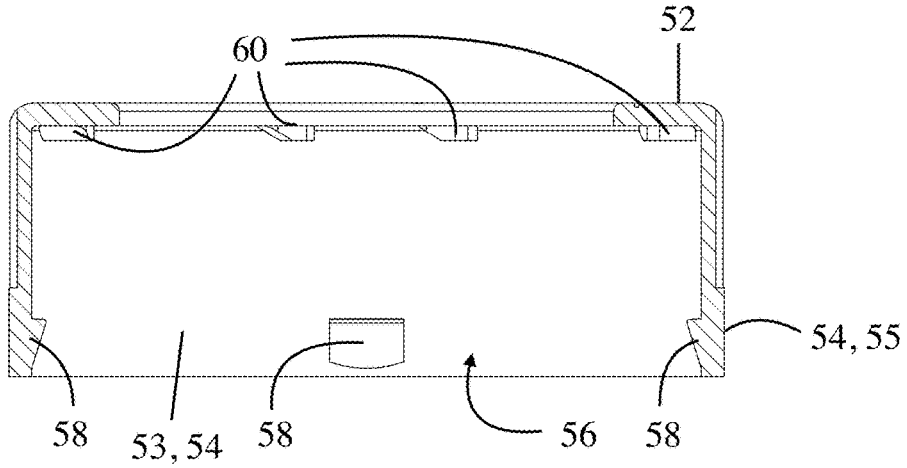
FIG. 10A is a cross sectional view taken from plane "A" of FIG. 10.

As best shown in the exploded view of FIG. 9B, each of the plurality of driving structures 60 of the CR element 50 is preferably in the form of a ratchet ramp having an at least partially angled ramp surface 62 that ends at a vertical member 64 extending towards and substantially perpendicular to the top surface 52 of the CR element 50. Accordingly, when turning the CR element 50 in the first direction, the plurality of ratchet ramps 60 of the CR element engage the plurality of recesses 42 of the NCR cap 30 via each vertical member 64 engaging an appropriate side wall 43 of a recess 42. However, when turning the CR element 50 in the second direction, the ramp surfaces 62 are unable to engage the opposing side wall 43 of the recesses 42 without a depressive axial force being applied to the CR element 50. In other words, while the ratchet ramps 60 are able to engage the driving structures 40 to turn the NCR cap 30 in the first direction via simply rotating the CR element 50 for installing the assembled child resistant cap onto a container, the ramp surfaces 62 are configured so that the ratchet ramps 60 are unable to engage the driving structures 40 in the second direction unless a user applies a "push-down-and-turn" action on the assembled closure.

Figure 11:
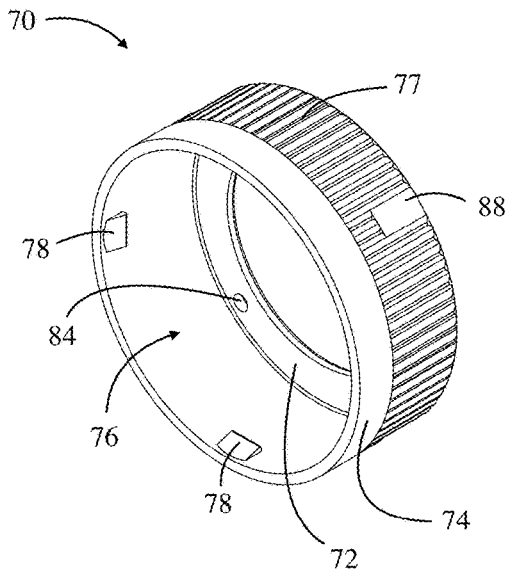
FIG. 11 is a bottom perspective view of a CP element according to one embodiment of the disclosure.
Figure 12:
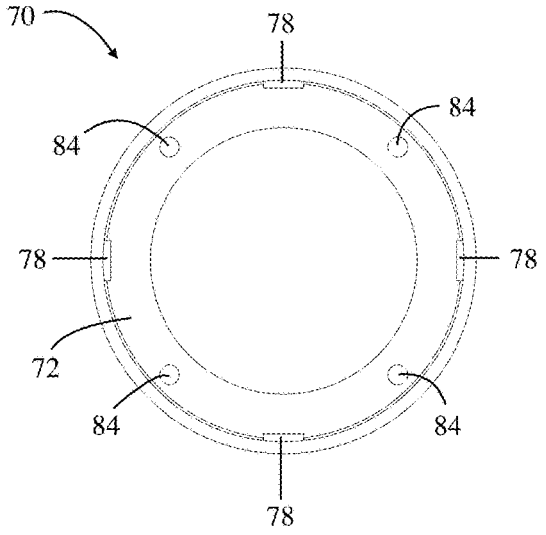
FIG. 12 is a bottom view of the CP element of FIG. 11.
Figure 13:
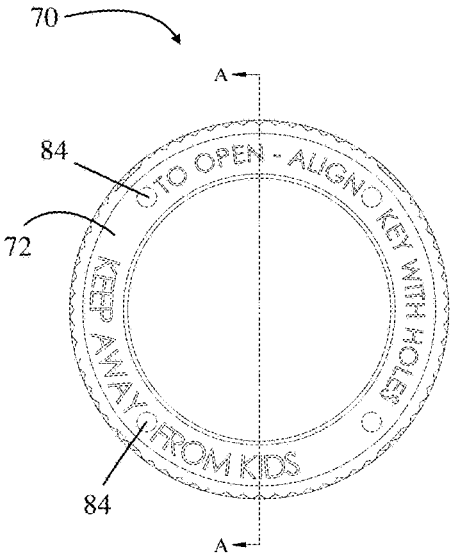
FIG. 13 is a top view of the CP element of FIGS. 11-12.
Figure 13A:
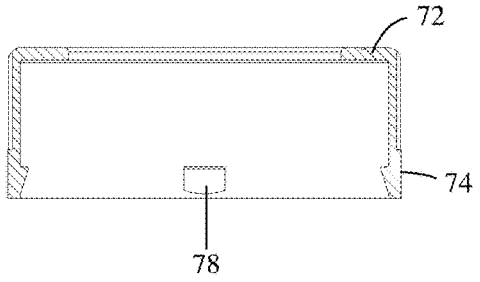
FIG. 13A is a cross sectional view taken from plane "A" of FIG. 13.

Referring to FIGS. 11-13, the CP element 70 also includes a top surface 72, a circumferential side wall 74 extending downward from an outer periphery of the top surface 72 to create an open bottom 76, and a plurality of ramps 78 for engaging the bottom surface 36 of the NCR cap 30 to secure the NCR cap 30 within the CP element 70. However, unlike the CR element 50, the interior surface of top surface 72 is preferably substantially smooth or otherwise does not include any driving structures operable to engage the driving structures 40 of the NCR cap 30 in the child proof mode. Thus, a customer is unable to remove the assembled child proof cap from a container when the closure system is in a child proof mode by applying a "push-down-and-turn" action on the assembled closure. Similarly, according to this embodiment, a customer is unable to install the assembled child proof cap on a container when the closure system is in a child proof mode. In order to remove the child proof cap, the CP element 70 includes one or more apertures 84 extending through the top surface 72 such that a key 90 may be inserted through the one or more apertures 84 to engage the NCR cap 30. Upon engagement, the NCR cap 30 may be screwed on and off a container by rotating the CP element 70 and/or key 90 in the appropriate direction.

In an alternate embodiment of CP element 70, the interior top surface includes modified driving structures configured for permitting the NCR cap 30 of the assembled child proof cap to be rotated in the first direction for screwing the cap onto a container while preventing the NCR cap 30 of the assembled child proof cap from being rotated in the second direction for screwing the cap off a container even when a depressive force is applied. For example, CP element 70 could include ratchet ramps similar to the ramps 60 of CR element 50 but with an elongated ramp surface configured to be unable to engage the appropriate side wall 43 of NCR cap 30 when the CP element 70 is rotated in the second direction even when a depressive force is also applied. In addition, one or both of the CP element 70 and NCR cap 30 may be provided with a slip agent or additive that further assists in preventing the ratchet ramp of the CP element 70 from driving structure 40 of the NCR cap.

In embodiments with a slip agent, the slip agent includes an ultra high molecular weight ("UHMW") polymer molded into the CP element 70 and/or NCR cap 30 to serve as a lubricating agent and provide enhanced lubricity between contacting surfaces. In preferred embodiments, the UHMW polymer, a term used to refer to macromolecules with molecular weights that exceed $10^6$ g/mol, is selected from a polymer such as polyethylene, polypropylene, polystyrene, polyisobutylene, polyacrylamide, polyisoprene, polyethyleneoxide, polytetrafluoroethylene, polymethylmethacrylate, polyvinylalcohol, polyacrylicacid, polyvinylacetate, nylon-6, nylon-4, and siloxane. In most preferred embodiments, the UHMW polymer is UHMW siloxane. In typical embodiments, the UHMW polymer is provided as an UHMW lubricating additive that includes approximately 25-70%, and most preferably about 50%, of the UHMW polymer dispersed in a thermoplastic carrier resin such as high-density polyethylene (HDPE), polypropylene (PP), acetal, high impact polystyrene (HIPS), or styrene-acrylonitrile (SAN). In preferred embodiments, the carrier resin is a HDPE polymer. A compatible UHMW lubricating additive having siloxane as the UHMW polymer and a HDPE polymer as its carrier resin is available commercially as DOW CORNING® MB50-314 Masterbatch.

According to this alternate embodiment, the amount and type of the slipping additive, as well as the slope of the ramp surfaces, can be varied as desired to vary the ability to open the container without the use of a key as described below. In preferred embodiments, the slope and slipping additive are used to make it essentially impossible to remove the child proof cap from a container. However, in certain embodiments, it may be desired to allow for both a highly forceful push-down-and-turn functionality in addition to the key opening.

Figure 14:
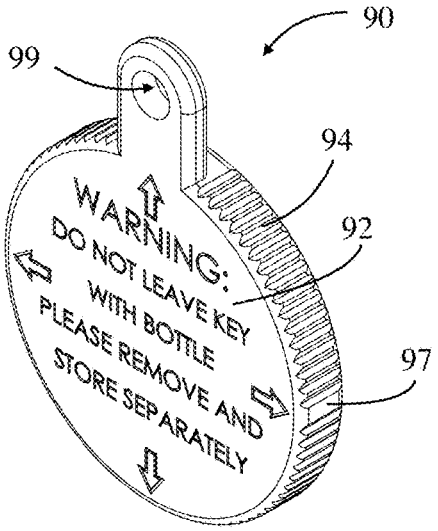
FIG. 14 is a top perspective view of a key according to one embodiment of the disclosure.
Figure 15:
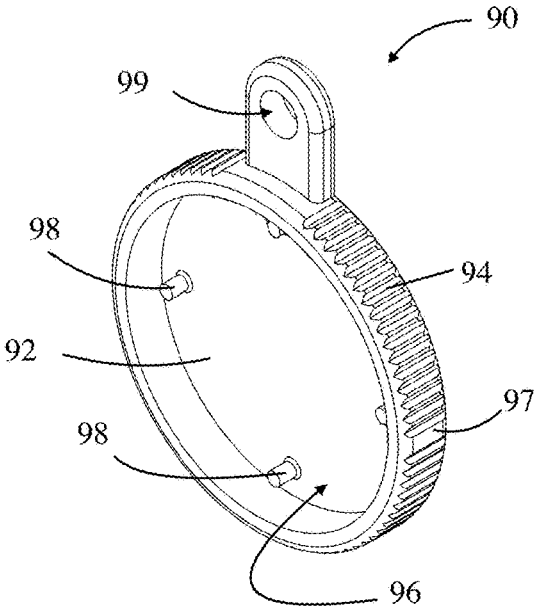
FIG. 15 is a bottom perspective view of the key of FIG. 14.
Figure 16:
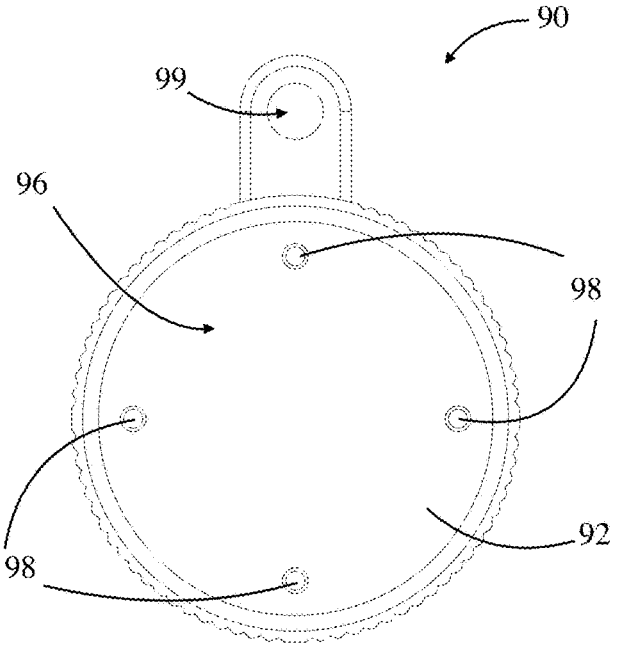
FIG. 16 is a bottom view of the key of FIGS. 14-15.

As exemplified in FIGS. 14-16, the key 90 includes a handle portion, at least one unlocking pin or projection 98 extending from the handle portion, and a key ring aperture 99 for securing the key 90 to a user's key ring to prevent loss of the key 90. While a preferred key is shown and described below, it should be understood that many different types of key configurations and designs may be utilized within the scope of the present disclosure such that the key includes a projection operable to engage the NCR cap 30 through the CP element 70. It should also be understood that the projections 98 of key and apertures 84 of CP element 70 may be configured to engage any appropriately configured driving structure of NCR cap 30 within the scope of the present disclosure. However, in preferred embodiments and as exemplified in the NCR cap 30, CP element 70, and key 90 shown in FIGS. 2-16, the projections 98 of key 90 and apertures 84 of CP element 70 are each positioned and configured so that they may be vertically aligned with the driving structures 40 of the NCR cap 30 upon rotation of the CP element 70 with respect to the NCR cap 30. Thus, upon vertical alignment, the projections 98 of key 90 may be inserted through the apertures 84 of the CP element 70 to engage the same driving structures 40 of the NCR cap 30 that ramps 60 of CR element 50 are configured to engage. As a result, the NCR cap 30 does not require an additional structure for receiving the key and the NCR cap 30 is able to include a solid interior top surface (i.e., the problem described in the Background section herein of prior art key related closure systems having a centrally located pocket having a necessary depth that extends into the interior space of the inner cap to receive a key is avoided), which allows the closure system 10 to be induction sealed and reduces the amount of resin needed to mold the NCR cap 30.

In addition to using the same driving structures 40 to engage the driving structure 60 of the CR element 50 and the one or more projections 98 of key 90 through the CP element 70, configuring the driving structures 40 to include "pockets" as described above with opposing perpendicular side walls 43 and the driving structures 60 of the CR element 50 as ratchet ramps 60 (as opposed to the ratchet ramps being included on the inner cap of traditional two-piece push-down-and-turn child resistant caps) provides the multi-faceted closure system 10 with the ability to use the same NCR cap 30 for both the assembled child resistant cap and the assembled child proof cap. In this regard, the pockets 40 (1) are not used when the NCR cap 30 is installed alone on the container in a non-child resistant mode; (2) provide an appropriately configured driving structure that is operable to be engaged by the ramps 60 of the CR element 50 when rotating the CR element 50 of the assembled child resistant cap in both the first direction and the second direction (with the second direction also requiring a depressive force); and (3) provide an appropriately configured driving structure that is operable to be engaged by the projection 98 of key 90 such that the key 90 may be used to rotate the child proof cap in both the first direction and second direction (or engaged by the key 90 through an "enhanced" CR element 50 that provides the customer with the option of using the key 90 to screw on and off the assembled child resistant cap).

Yet another advantage of adapting the driving structure 40 of the NCR cap 30 to include pockets configured to receive the projection 98 of key 90 is that the height of the NCR cap 30 is able to be decreased, resulting in a more aesthetically pleasing appearance of the closure assembly 10 and a closure assembly 10 that may be produced more efficiently. The reduction in size is a result of the NCR cap 30 (1) not needing an additional indention to receive the key; and (2) the inclusion of pockets 40 disposed within the top surface 32 of NCR cap 30 instead of ramps or other locking mechanisms protruding from the top surface 32. In preferred embodiments, the thickness of the top surface 32 of the NCR cap 30 is about 1.25 mm to about 1.5 mm with the recess 42 extending about 0.9 mm to about 1 mm into the top surface 32.

While key 90 may include only one projection 98, in preferred embodiments and as shown in FIGS. 14-16, the key 90 includes at least one set of spaced apart projections 98 that are operable to be inserted through appropriately spaced apertures 84 of CP element 70 to engage a plurality of the pockets 40 of NCR cap 30. Due to the spaced apart projections 98 engaging a plurality of pockets 40 along the outer periphery of the NCR cap 30, use of the key 90 adds a significant fulcrum effect/mechanical advantage to the customer and enables the child proof cap to be more easily tightened and removed by rotating the key 90 as opposed to the CP element 70. Further, as shown, the handle portion of key 90 may also include a width that is substantially equal to or greater than the diameter of the CP element 70 to further increase this mechanical advantage. Accordingly, use of key 90 is multifunctional—it unlocks the child proof cap and also converts the child proof cap into an easy open container upon proper use of the key 90. Thus, as noted above, the CR element 50 of preferred embodiments also includes similar apertures 64 to apertures 84 of CP element 70 to take advantage of this mechanical advantage if desired with the child resistant cap by using key 90. This "enhanced" child resistant cap (i.e., "enhanced" by virtue of also permitting a key to be used to screw on and off the cap with respect to a container) is particularly useful for the elderly that have trouble opening child resistant closures but also have caregivers that often dispense their medications. Thus, the elderly individual may use the key 90 to remove the child resistant cap themselves, while the caregiver may open the container using the normal child resistant function. Also, the enhanced child resistant cap is beneficial when the child resistant cap is secured to a container in an automated dispensing system as inspection workers can use the key 90 to easily screw on and off the child resistant caps from the containers being inspected and alleviate carpal tunnel syndrome symptoms.

In yet another aspect of the disclosure, the apertures 84 of CP element 70 (or apertures 64 of the enhanced CR element 50) are preferably sufficiently small such that the potential for alignment of the apertures 84 with the driving structures 40 of the NCR cap 30 is not immediately discernible when viewing the assembled child proof cap, at least to a child. In particular, due to the small size of apertures 84, it is not immediately recognizable that the NCR cap 30 even has driving structures 40 when assembled with the CP element 70. Further, the small size of apertures 84 prevent typical household items such as coins, screwdrivers, etc. from being used as keys. Thus, according to preferred embodiments, the set of small projections 98 of key 90 and small apertures 84 of CP element 70 are provided to prevent people from removing the child proof cap unless they have the specially designed key 90, and, even if they have the key 90, know exactly how the key 90 should be used to remove the child proof cap installed on a container in the child proof mode. Such a system not only "child proofs" the closure, but the system serves as an effective deterrent for older adolescents as well as house visitors that do not have easy access to the specially designed key. In preferred embodiments, apertures 84 are less than about 3 mm in diameter, however it is noted that the size can vary depending on the stiffness and strength of the material used for forming the projections 98 of the key 90 as stronger materials for the projections 98 (e.g., steel) permit the projections 98 to be even smaller.

In order to assist in alignment of the projections 98 of key 90 with the apertures 84 of the CP element 70, the handle portion of the key 90 is preferably dimensioned and configured to correspond to the dimensions of the CP element 70 (or to correspond to apertures 64 and dimensions of the enhanced CR element 50). For example, as shown, key 90 preferably includes a top/base surface 92 and a circumferential side wall 94 extending from an outer periphery of the top surface 92 to form a bottom key opening 96. The projections 98 extend from the base surface 92 in axial alignment with the circumferential side wall 94, and the circumferential side wall 94 includes an internal diameter that corresponds to the outer diameter of the CP element 70 (e.g., the internal diameter of the side wall 94 is slightly greater than the outer diameter of side wall 74). As a result, the key 90 may be placed over the child proof cap such that the base surface 92 of the key 90 is placed over the top surface 72 of the CP element 70 and the internal surface of side wall 94 of the key 90 at least partially extends down the external surface of side wall 74 of the CP element 70. The projections 98 are then positioned such that rotation of the key 90 with respect to the CP element 70 results in the projections 98 of key 90 becoming aligned with apertures 84 of the CP element 70. The projections 98 then become aligned with the recesses 42 of the NCR cap 30 upon further rotation of the key 90 such that the side wall 94 of key 90 slides further down the side wall 74 of the CP element 70. At this point, the top surface 92 of the key 90 is contacting the top surface 72 of the CP element 70, and the customer knows that the key 90 is aligned with the child proof cap such that rotation of the key 90 will rotate the cap on and off the container.

According to an alternate embodiment, only a portion of side wall 94 extends from the base surface 92 such that side wall abuts only a portion of side wall 74 of the CP element 70. To align, the portion of side wall 94 is rotated along the side wall 74 until the one or more projections 98 align with the one or more apertures 84.

To further assist a customer in aligning the projections 98 with apertures 84 of CP element 70, the exterior surface 75 of side wall 70 preferably includes a discrete alignment feature indicating the location of the apertures 84 on the top surface 72 of the CP element 70. In preferred embodiments, and as shown in the drawings, the alignment feature includes a small break 88 in the knurlments 77 of the CP element 70 (and breaks 68 in knurlments 57 of an enhanced CR element 50). Similarly, the key 90 may also include breaks 97 in knurlments indicating location of the projections 98. Such breaks in the knurlments are not only visible to a person with relatively good eyesight, they are able to be located by feel by those with poor eyesight.

Figure 17:
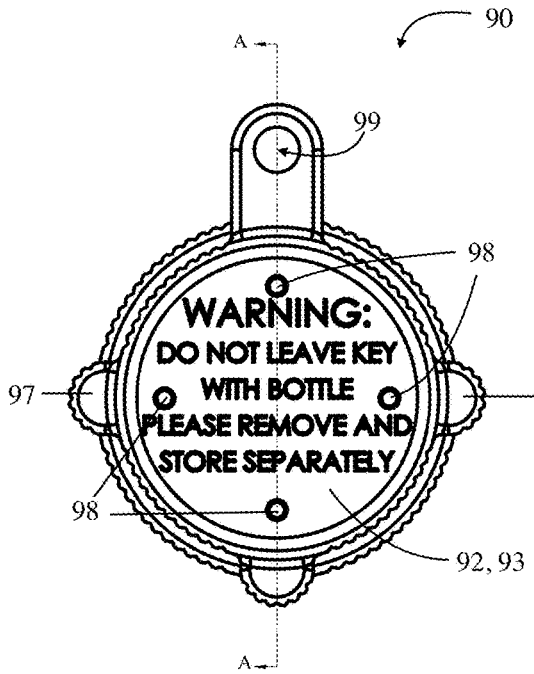
FIG. 17 is an top view of a second side of a key according to another embodiment of the disclosure.
Figure 18:
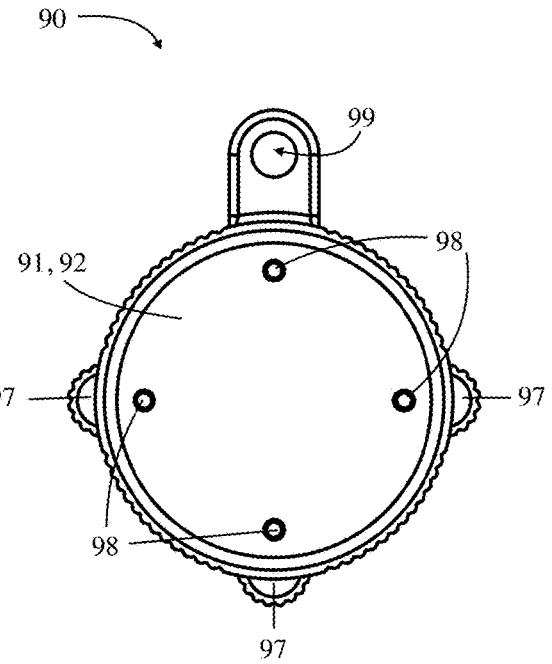
FIG. 18 is a top view of a first side of the key of FIG. 17.
Figure 17A:
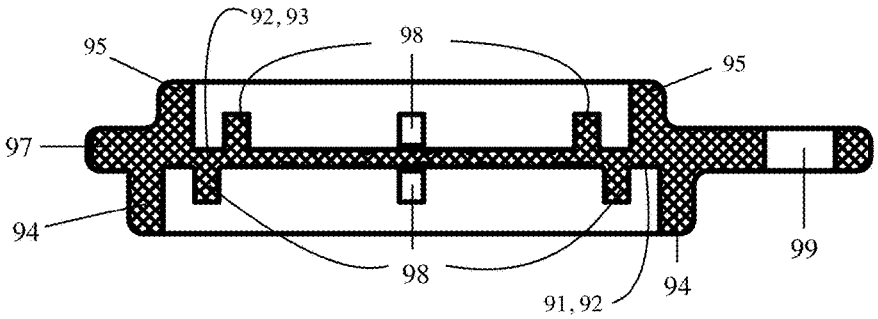
FIG. 17A is a cross sectional view taken from plane "A" of FIG. 17.

Referring to FIGS. 17-18, another embodiment of key 90 is shown designed to open closure systems of different sizes. Thus, according to this embodiment, the top surface 92 includes a first side 91 and a second side 93. A first circumferential side wall 94 extends from the first side 91 in the same direction as projections 98 while a second circumferential side wall 95 extends from the second side 93 in the same direction as another set of projections 98. As shown, the first circumferential side wall 94 includes a greater diameter to correspond with CP elements 70 having larger diameters while the second side wall 95 includes a smaller diameter to correspond with CP elements 70 with smaller diameters. As shown, instead of breaks in the knurlments, another alignment feature could include projections 97 from the side walls at the location of the projections 98.

In yet another aspect, the NCR cap 30 preferably includes indicium warning the user that the closure system 10 is in a non-child resistant mode (i.e., CAUTION: NOT CHILD RESISTANT) that is visible only when the NCR cap 30 is installed on the container unassembled from the CR element 50 or CP element 70. For example, indicium may be positioned on the closed top surface 32 such that it is covered by the CR element 50 when the closure system is in a child resistant configuration or covered by the CP element 70 when the closure system is in a child proof configuration. In particular, when the CR element 50 and CP element 70 include an open top surface as shown, the indicium is disposed around the periphery of the top surface 32 of the NCR cap 30. While the indicium may be molded directly into the top surface 32, the NCR cap 30 is preferably see-through such that the indicium may be provided on a liner that is inserted into the interior of the NCR cap 30. Further, in embodiments where the warning is disposed on the outer periphery of the liner, the interior portion of the liner may include additional indicium such as promotional messages, prescription instructions, etc.

Additionally, as shown, indicium may be provided on the top surface 52 of the CR element 50 informing the user that the structure is the CR element 50 and/or giving instructions on how to open the closure system 10 in the child resistant configuration. For example, the indicium may state "TO OPEN PUSH DOWN AND TURN," which both gives notice to the user that the structure is the CR element 50 and provides opening instructions for the child resistant configuration. Similarly, indicium may also be provided on the top surface 72 of the CP element 70 informing the user that the structure is the CP element 70 and/or giving instructions on how to open the closure system 10 in the child proof mode such as "TO OPEN ALIGN KEY WITH HOLES" as shown. Alternatively, the function of the child proof cap may be hidden by using more discrete in identifying the CP element 70 and providing the operating instructions for the assembled child proof cap on the key.

Figure 19:
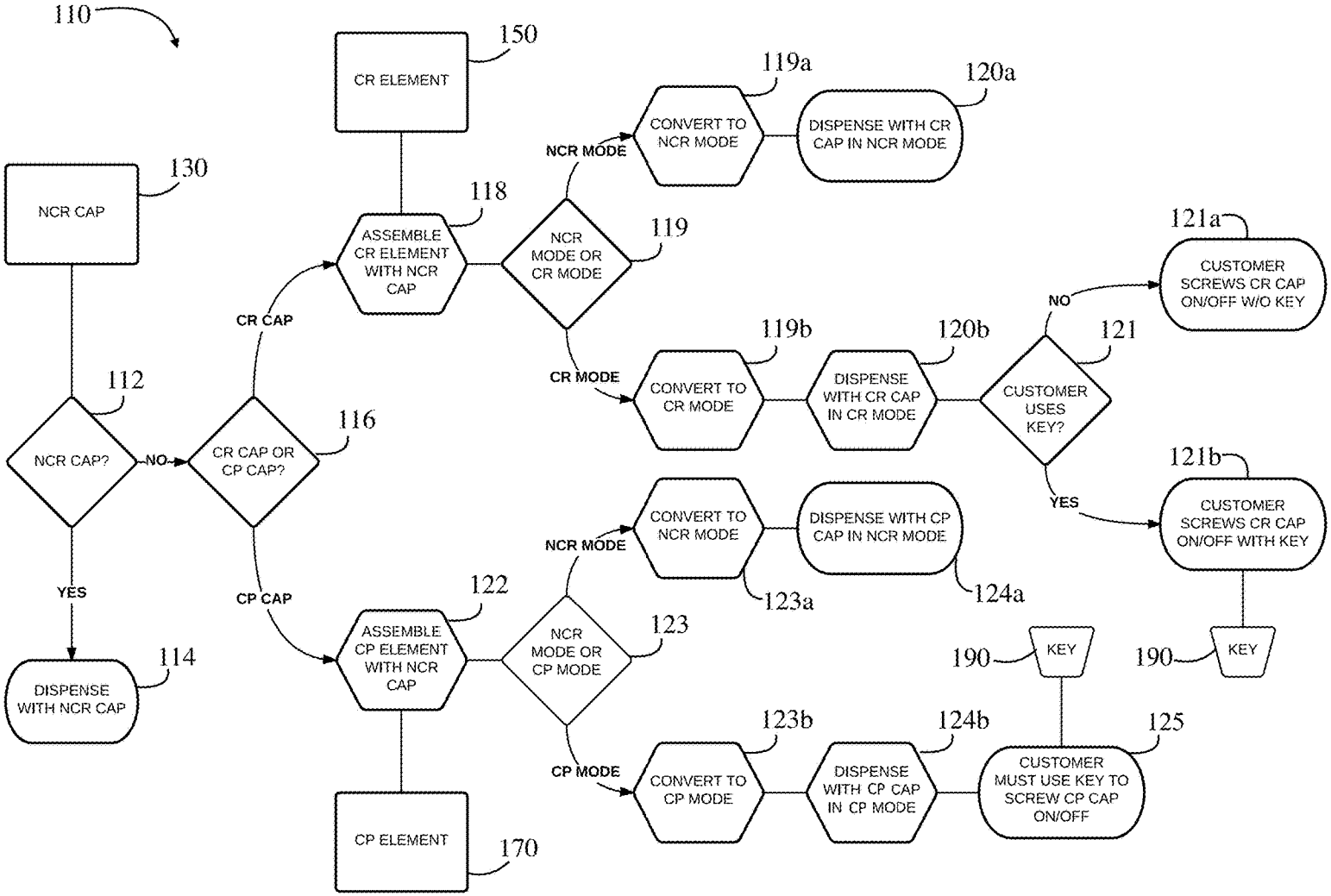
FIG. 19 is a flow chart depicting an exemplary methodology for dispensing and using a convertible closure system according to one embodiment of the disclosure.

Referring to the flow chart of FIG. 19, another embodiment of closure system is provided where the child resistant cap and child proof cap further include a non-child resistant mode. In other words, the assembled child resistant cap is operable to be converted between a child resistant mode and a non-child resistant mode, and the assembled child proof cap is operable to be converted between a child proof mode and a non-child resistant mode.

Similar to the closure system 10, convertible closure system 110 includes a NCR cap 130, a CR element 150, and a CP element 170. In step 112, a user first determines whether only the NCR cap 130 is needed. If only a NCR cap 130 is needed or desired, the user dispenses the pharmaceutical with just the NCR cap 130 installed to the container in step 114. On the other hand, if the user determines in step 112 that a more difficult to open closure system is needed, the user next determines in step 116 whether a child resistant cap or a child proof cap is desired. When the user determines in step 116 that a child resistant cap is desired, the user assembles the CR element 150 with the NCR cap 130 to form a child resistant cap in step 118. On the other hand, when the user determines in step 116 that a child proof cap is desired, the user assembles the CP element 170 with the NCR cap 130 to form a child proof cap in step 122.

While the above is generally the same as closure system 10, closure system 110 also gives the user and/or customer the option to convert the child resistant cap or child proof cap to either a non-child resistant mode or a child resistant/proof mode. For example, a customer may be an elderly person that lives by themselves but occasionally has grandchildren come visit. Thus, in step 112 for example, in addition to determining that a NCR cap is not sufficient, the user also determines that a convertible closure system 110 is preferred over a non-convertible system 10. Then, prior to dispensing the child resistant cap or child proof cap as desired, the user determines in step 119 (after choosing a convertible child resistant cap) or step 123 (after choosing a convertible child proof cap) whether to dispense the pharmaceutical in the non-child resistant mode or the child resistant/proof mode and converts the requested cap in the appropriate step 119*a/b* or 123*a/b* prior to dispensing the requested cap in the desired manner in step 120*a/b* or 124*a/b*. As shown in step 125, when the child proof cap is dispensed in the child proof mode, the customer must use key 190 to screw the child proof cap on and off. Further, as shown in step 121, when an enhanced child resistant cap is provided in a child resistant mode (or the customer later converts an enhanced child resistant cap from the non-child resistant mode to the child resistant mode), the customer has the further option to screw the enhanced child resistant cap on and off a container without a key (step 121*a*) or with a key (121*b*).

Figure 20:
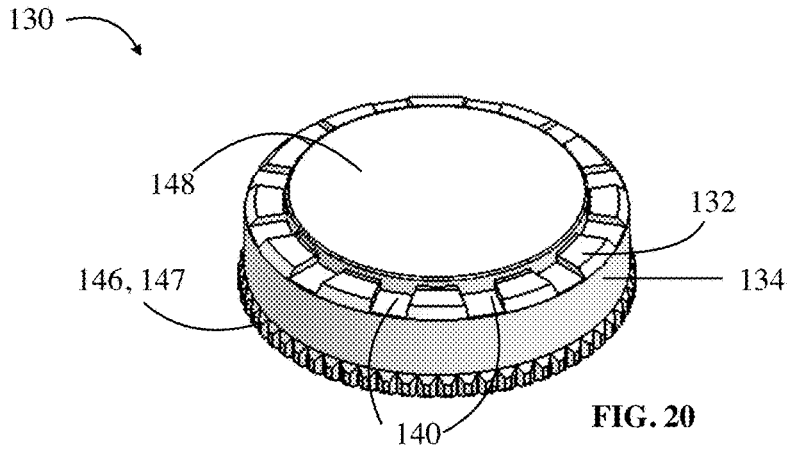
FIG. 20 is a side perspective view of a NCR cap according to another embodiment of the disclosure.
Figure 21:
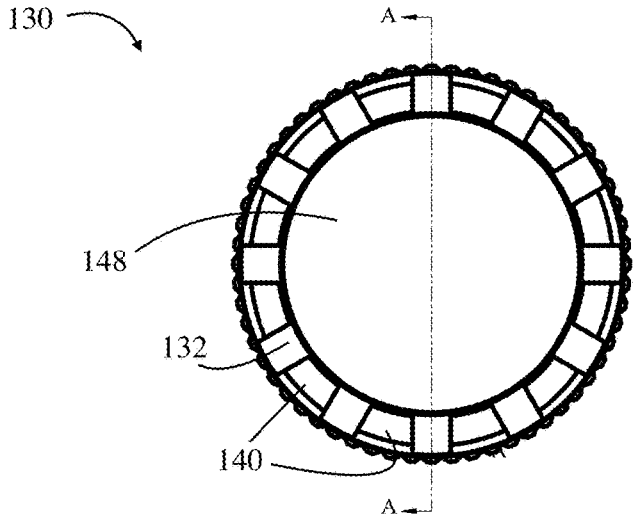
FIG. 21 is a top view of the NCR cap of FIG. 20.
Figure 21B:
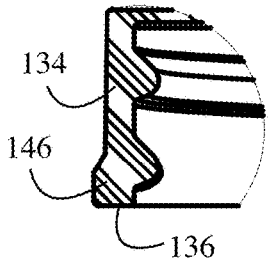
FIG. 21B is an exploded view of region "B" of FIG. 21A.
Figure 21A:
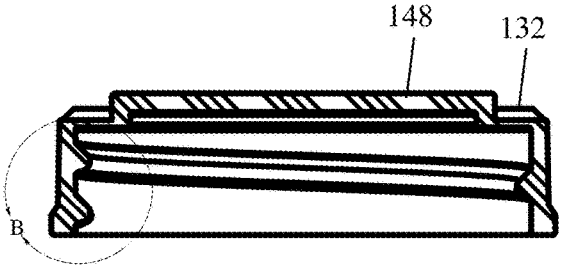
FIG. 21A is a cross sectional view taken from plane "A" of FIG. 21.
Figure 22:
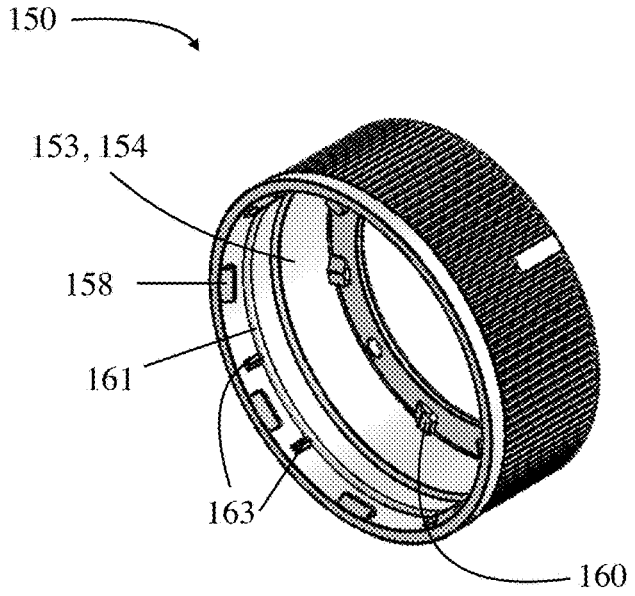
FIG. 22 is a bottom perspective view of a CR element according to another embodiment of the disclosure.
Figure 23:
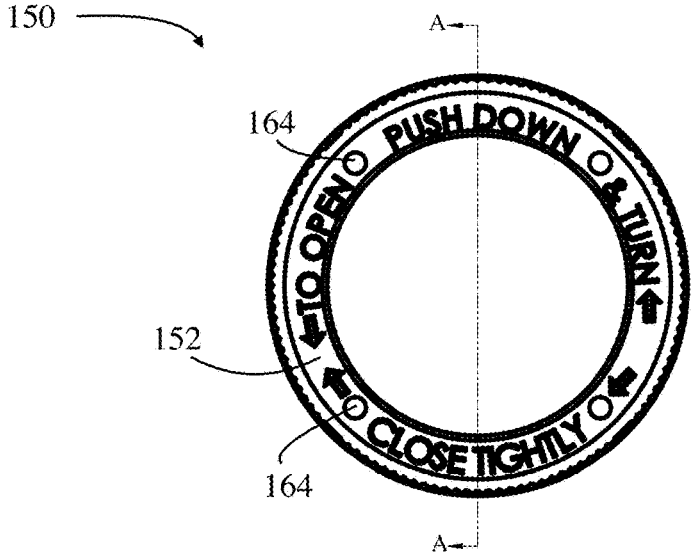
FIG. 23 is a top view of the CR element of FIG. 22.
Figure 23A:
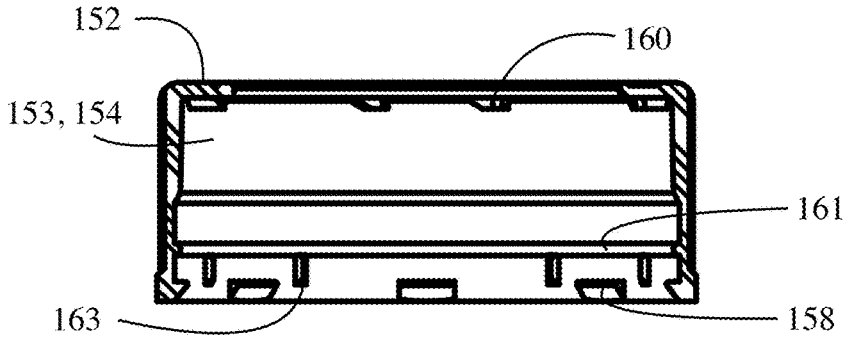
FIG. 23A is a cross sectional view taken from plane "A" of FIG. 23.
Figure 24:
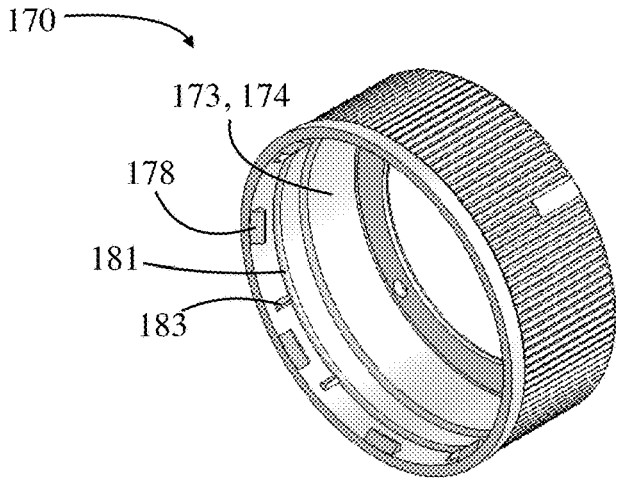
FIG. 24 is a bottom perspective view of a CP element according to another embodiment of the disclosure.
Figure 25:
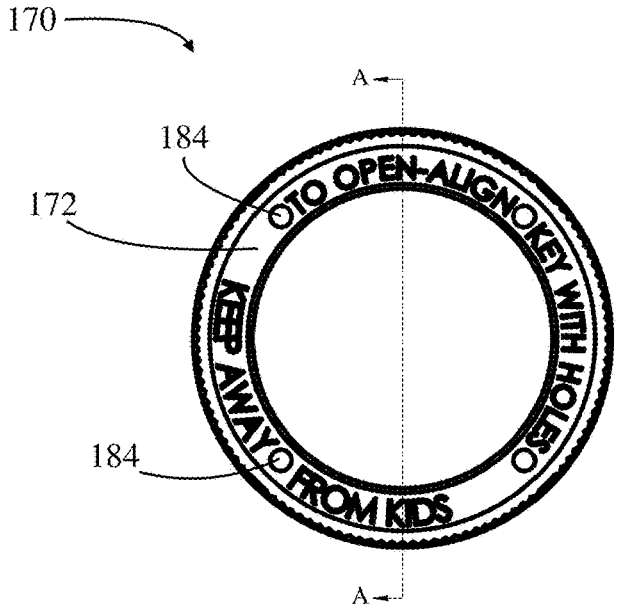
FIG. 25 is a top view of the CP element of FIG. 24.
Figure 25A:
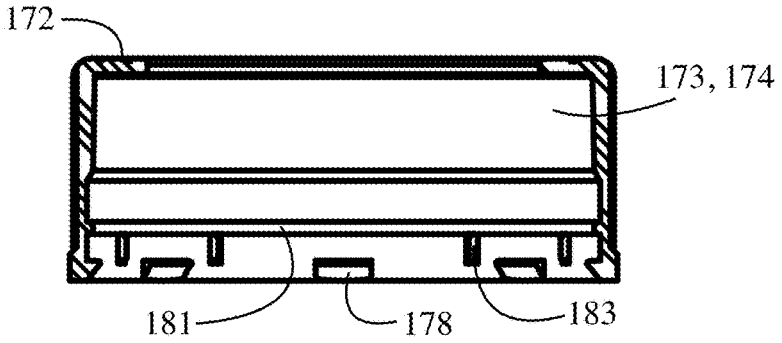
FIG. 25A is a cross sectional view taken from plane "A" of FIG. 25.

One embodiment of closure system 110 is exemplified in FIGS. 20-25. As shown, convertible closure system 110 is similar to system 10 described above except for a couple of key differences. First, as shown in FIGS. 20-21, NCR cap 130 includes an outer skirt 146 disposed adjacent the bottom surface 136 of the sidewall 134. The outer skirt 146 includes a plurality of spokes 147 positioned thereon in axial alignment with the side wall 134. The top surface 132 of NCR cap 130 also includes a dome 148 disposed proximate the interior of the driving structures 140 extending coaxially with the circumferential side wall but in the opposite direction from the top surface 132. Then, as shown in FIGS. 22-25, CR element 150 and CP element 170 include a second tab element 161, 181 disposed on the interior surface 153, 173 of their respective side wall 154, 174 above tab element 158, 178. Finally, the interior surface 153, 173 of the side walls 154, 174 include a plurality of spokes 163, 183 disposed between their respective tab elements and in axial alignment with their respective side wall 154, 174.

These additions allow the NCR cap 130 to be positionable within the CR element 150 and CP element 170 between a non-child resistant mode and a child resistant/child proof mode. With respect to the child resistant mode of the assembled convertible child resistant cap, the outer skirt 146 of the NCR cap 130 is positioned above tab element 161 of the CR element 150. In this child resistant mode, the driving structures 160 of the CR element engage the driving structures 140 of the NCR cap in a similar manner as described with respect to the driving structures 60 and 40 of closure assembly 10. However, to convert the child resistant cap to the non-child resistant mode, the user/customer pushes down on the dome 148 such that outer skirt 146 of the NCR cap is disposed between tab elements 158 and 161. In this non-child resistant mode, the plurality of spokes 147 of outer skirt 146 engages the plurality of spokes 163 on the side wall 156 to secure the NCR cap 130 within the CR element 150. Thus, rotation of the CR element 170 in the non-child resistant mode causes the NCR cap 130 to be rotated when the assembled child resistant cap is installed on a container in the non-child resistant mode. The convertible child proof cap operates in a similar manner except a key is required to rotate the NCR cap in the child proof mode due to the CP element 170 not including any driving structures on its interior top surface.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A closure system comprising:

an inner cap including at least one driving structure;

a child proof element separated from the inner cap and being configured to be assembled with the inner cap to form a child proof cap, the child proof element when assembled with the inner cap is configured so that the inner cap is positionable within the child proof element to convert the assembled child proof cap between the child proof mode and a non-child resistant mode; and a key having at least one projection, wherein the child proof element when assembled with the inner cap in the child proof mode is configured to require the at least one projection of the key to engage the at least one driving structure of the inner cap to remove the assembled child proof cap when the child proof cap is installed on the container.

2. The closure system of claim 1 wherein the inner cap is configured to screw on and off the container in a non-child resistant mode to allow ready removal of the closure system when only the inner cap is installed on the container.

3. The closure system of claim 1 wherein, when the inner cap is positioned within the child proof element in the non-child resistant mode, the assembled child proof cap is operable to be screwed on and off the container without requiring the key.

4. The closure system of claim 1 wherein the inner cap includes a plurality of driving structures each including a recess disposed in a periphery of a top surface of the inner cap, the recess including a bottom wall in axial alignment with the top surface and a pair of opposing side walls extending substantially perpendicular from the bottom wall to the top surface.

5. The closure system of claim 1 wherein the key includes a top surface and a side wall extending downward from the top surface, the at least one projection extending downward coaxially with the side wall.

6. The closure system of claim 5 wherein the child proof element includes a side wall extending downward from a top surface, the key being dimensioned and configured to correspond to the child proof element such that at least a portion of the top surface of the key abuts the top surface of the child proof element and at least a portion of the side wall of the key abuts the side wall of the child proof element when the at least one projection of the key is engaged with the at least one driving structure of the inner cap.

7. The closure system of claim 6 wherein the side wall of the key is operable to slide down a portion of the side wall of the child proof element upon the at least one projection of the key engaging the at least one driving structure of the inner cap.

8. A closure system comprising:

an inner cap including a top surface, a circumferential side wall disposed below the top surface, and a plurality of driving structures disposed proximate a periphery of the top surface of the inner cap, each of the plurality of driving structures including a recess formed into the top surface, and each of the recesses having a bottom wall disposed at least partially on top of the side wall or formed into the side wall;

a child proof element separated from the inner cap and being configured to be assembled with the inner cap to form a child proof cap having a child proof mode; and a key having a plurality of projections, wherein the child proof element when assembled with the inner cap in the child proof mode is configured to require the plurality of projections of the key to engage at least a portion of the plurality of driving structures of the inner cap to remove the assembled child proof cap when the child proof cap is installed on the container.

9. The closure system of claim 8 wherein the recess of each of the plurality of driving structures of the inner cap includes the bottom wall in axial alignment with the top surface and a pair of opposing side walls extending substantially perpendicular from the bottom wall to the top surface.

10. The closure system of claim 8 wherein the key includes a top surface and a side wall extending downward from the top surface, the plurality of projections extending downward coaxially with the side wall.

11. The closure system of claim 10 wherein the child proof element includes a side wall extending downward from the top surface, the key being dimensioned and configured to correspond to the child proof element such that at least a portion of the top surface of the key abuts the top surface of the child proof element and at least a portion of the side wall of the key abuts the side wall of the child proof element when the plurality of projections of the key are engaged with at least the portion of the plurality of driving structures of the inner cap.

12. The closure system of claim 11 wherein the side wall of the key is operable to slide down a portion of the side wall of the child proof element upon the plurality of projections of the key engaging the at least a portion of the plurality of driving structures of the inner cap.

13. The closure system of claim 8 wherein the plurality of driving structures of the inner cap are disposed in a circular array proximate the periphery of the top surface of the inner cap.

14. A closure system comprising:

an outer cap including a plurality of driving structures;

an inner cap dimensioned and configured to be assembled within the outer cap to form an assembled child resistant cap having at least a child resistant mode, the inner cap including:

a closure engaging mechanism disposed on an interior surface of the inner cap, the closure engaging mechanism dimensioned and configured to engage a corresponding container engaging mechanism for securing the inner cap to a container, a plurality of driving structures, at least some of the plurality of driving structures of the inner cap being operable to engage the plurality of driving structures of the outer cap in the child resistant mode when the outer cap is turned in a first direction to screw the assembled closure onto a container and to permit removal of the assembled child resistant cap upon a push-down-and-turn action being applied to the outer cap in a second direction, and at least one key receiver disposed proximate an exterior surface of the inner cap; and a key having at least one projection extending from a handle portion, the at least one projection dimensioned and configured to engage the at least one key receiver of the inner cap for removing the assembled child resistant cap from the container when the key is rotated in the second direction.

15. The closure system of claim 14 wherein the assembled child resistant cap is configured so that the inner cap is positionable within the outer cap to convert the assembled child resistant cap between the child resistant mode and a non-child resistant mode.

16. The closure system of claim 14 wherein the plurality of driving structures of the inner cap includes the at least one key receiver.

17. The closure system of claim 14 wherein each of the plurality of driving structures of the inner cap include a recess disposed in a top surface of the inner cap, the recess including a bottom wall in axial alignment with the top surface and a pair of opposing side walls extending substantially perpendicular from the bottom wall to the top surface.

18. The closure system of claim 14 wherein the key includes a top surface and a side wall extending downward from the top surface, the at least one projection extending downward coaxially with the side wall.

19. The closure system of claim 18 wherein the outer cap includes a side wall extending downward from a top surface, the key being dimensioned and configured to correspond to the outer cap such that at least a portion of the top surface of the key abuts the top surface of the outer cap and at least a portion of the side wall of the key abuts the side wall of the outer cap when the at least one projection of the key is engaged with the at least one key receiver of the inner cap.

20. The closure system of claim 19 wherein the side wall of the key is operable to slide down a portion of the side wall of the outer cap upon the at least one projection of the key engaging the at least one key receiver of the inner cap.

21. A closure system comprising:

a closure having a top surface, at least one side wall extending from an outer periphery of the top surface, a closure engaging mechanism dimensioned and configured to engage a corresponding container engaging mechanism for securing the closure to a container, and at least one key receiver; and a key for opening the closure system, the key comprising:

a base surface and at least one side wall extending from at least a portion of the base surface in a first direction, and at least one projection extending from the base surface in the first direction, the at least one projection dimensioned and configured to engage the at least one key receiver of the closure system to rotate the closure for disengaging the closure engaging mechanism from the container engaging mechanism, wherein the base surface and the at least one side wall of the key is dimensioned and configured to correspond to the closure such that the base surface of the key covers at least a portion of the top surface of the closure and at least a portion of the side wall of the key abuts the side wall of the closure when the at least one projection of the key is engaged with the at least one key receiver of the closure.

22. The closure system of claim 21 wherein the closure further includes an inner cap having the top surface, an outer cap including the at least one side wall, and a plurality of key receivers disposed around the periphery of the top surface of the inner cap, the key further comprising a plurality of projections extending from the base surface disposed adjacent the at least one side wall of the key configured to engage the plurality of key receivers of the inner cap to remove the closure from a container when the inner cap is assembled with the outer cap.

23. The closure system of claim 22 wherein the outer cap of the closure includes an outer ring having a plurality of apertures dimensioned and configured to cover the periphery of the top surface of the inner cap when the inner cap is assembled with the outer cap, the plurality of projections of the key positioned to be inserted through the plurality of apertures of the outer cap to engage the plurality of key receivers of the inner cap to remove the closure from a container when the inner cap is assembled with the outer cap.

24. The closure system of claim 21 wherein the key is dimensioned and configured so that the at least one projection will align with the at least one key receiver of the closure upon aligning the at least one side wall of the key to abut the at least one side wall of the closure and rotating the key with respect to the closure.

25. The closure system of claim 24 wherein the at least one side wall of the key is operable to slide down the at least one side wall of the closure upon the at least one projection of the key becoming aligned with and engaging the at least one key receiver of the closure.

26. The closure system of claim 21 wherein the closure includes a cylindrical top surface and a circumferential side wall and the base surface of the key is a cylindrical base surface and the at least one side wall of the key is a circumferential side wall to correspond to the cylindrical top surface and the circumferential side wall of the closure.

* * * * *